US007832904B2

(12) United States Patent
Doherty et al.

(10) Patent No.: US 7,832,904 B2
(45) Date of Patent: Nov. 16, 2010

(54) CONTROLLING REFLECTED LIGHT USING ELECTRONIC PAPER

(75) Inventors: John Doherty, San Francisco, CA (US); Eleanor Rieffel, Mountain View, CA (US)

(73) Assignee: Fuji Xerox Co., Ltd., Tokyo (JP)

( * ) Notice: Subject to any disclaimer, the term of this patent is extended or adjusted under 35 U.S.C. 154(b) by 332 days.

(21) Appl. No.: 12/030,838

(22) Filed: Feb. 13, 2008

(65) Prior Publication Data

US 2009/0200958 A1 Aug. 13, 2009

(51) Int. Cl.
*F21V 7/22* (2006.01)

(52) U.S. Cl. ..... 362/296.02; 362/295; 362/300

(58) Field of Classification Search ..... 362/276, 362/295, 296.02, 297, 298, 300, 303, 304, 362/305, 349, 394
See application file for complete search history.

(56) References Cited

U.S. PATENT DOCUMENTS 4,562,515 A * 12/1985 Lautzenheiser ..... 362/295
7,387,408 B2 * 6/2008 Holten et al. ..... 362/298

FOREIGN PATENT DOCUMENTS

JP 2004294954 A * 10/2004

OTHER PUBLICATIONS

H. Arisawa, et. al., "Photoaddressable Electronic Paper Using Cholesteric Liquid Crystal", IS&T NIP17-228 (2001).

Hiroshi Arisawa and Kiyoshi Shigehiro, Photo-addressable E-Paper and Toner Display, IS&T's NIP20: International Conference on Digital Printing Technologies, Salt Lake City, UT;Oct. 31, 2004; p. 922-926.

E Ink Corporation, http://www.eink.com/.

Fujitsu e-paper, http://www.fujitsu.com/global/about/rd/200509epaper.html.

FX Photo-addressable Electronic Paper, http://www.fujixerox.co.jp/eng/company/technical/epaper/index.html.

T. Kakinuma, et. al., "Black and White Photo-addressable Electronic Paper using Encapsulated Cholesteric Liquid Crystal and Organic Photoconductor", IDW '02, p. 1345 (2002).

H. Kobayashi, et. al., "A Novel Photoaddrsssable Electronic Paper Using Organic Photoconductor Utilizing Hydroxy Gallium Phthalocyanine as Charge Generation Material", Asia Display, p. 1731 (2001).

(Continued)

*Primary Examiner*—Y My Quach Lee
(74) *Attorney, Agent, or Firm*—Sughrue Mion, PLLC

(57) ABSTRACT

A system and a method for using ePaper as a light control media in lighting fixtures or other light enhanced applications to modify, dim or color-shift the light used for lighting the space. One system includes a light source, an ePaper reflector with controllable reflectivity for controlling the light reflected from the reflector and/or an ePaper baffle with controllable translucency for controlling the light through the baffle. The light incident on the ePaper media may include light from other sources such as natural light. One method compares desired lighting in a space to characteristics of the light source. Characteristics of the ePaper media are then adjusted to provide the desired amount of light to the objects under illumination. Reflectivity from walls and furniture may be controlled by applying ePaper to their surfaces. The light source and the ePaper media may be controlled simultaneously to control the lighting.

29 Claims, 12 Drawing Sheets

OTHER PUBLICATIONS

Liquavista, http://www.liquavista.com/.
Nemoptic, http://www.nemoptic.com/.
SiPix, http://www.sipix.com/.

S. Yamamoto, et. al., "A Novel Photoaddressable Electronic Paper Utilizing Cholesteric LC microcapsules and Organic Photoconductor", SID '01 Digest, p. 362 (2001).

* cited by examiner

CONTROLLING REFLECTED LIGHT USING ELECTRONIC PAPER

BACKGROUND

1. Field of the Invention

The present invention generally relates to the field of lighting and in particular to methods and systems for controlling reflected light in lighting applications.

2. Related Arts

Lighting in a space is determined not just by the type and location of light sources contributing to the lighting of the space but also by the filtering and reflective properties of various media impacted by the light that reaches the space. Filtering occurs at translucent or partially translucent material in the path of the light. Reflection occurs at surfaces of objects receiving the light. Color, brightness, angle and other reflective properties of the materials reflecting the light affect the characteristics of the reflected light. Reflected light may provide a large part of lighting in a space.

Illumination occurs in two ways: direct and indirect. Direct light travels toward the subject from the illumination source. Direct light is generally controlled by the type of the light source, for example incandescent versus fluorescent, by the media placed directly between the source and the subject, for example louvers or translucent diffusion media, and by electrical or electronic dimming. Indirect light is reflected off a surface toward which the direct light source is aimed and then brought back onto the subject by the reflective medium. Reflective range varies from highly reflective, mirror-like and focusable to highly diffused or "soft." Translucent media range varies from nearly clear to nearly opaque. Both types of diffusive media can be colored, as described below. Lighting fixtures utilize both direct and indirect light for various reasons related to the quality of light emitted by the specific component of the illumination process. Photographers, architects, and lighting fixture designers carefully choose the properties of lighting fixture's reflective surfaces to achieve the lighting effects they desire.

Both direct and indirect, or "bounce", sources are used to create professional lighting effects. Various colored media may be used to act as the reflective surface for the lighting source. Examples of the colored media that are used to act as the reflective surface include foam core and heavy paper art board. Primarily white, black and to a much lesser extent, silver and gold are used as the color of the colored media.

Performance of the lighting fixture and functionality of a light-enhanced application are affected by reflected light. Variable intensity reflectors are not common. A limited number of lighting fixtures use mechanically variable reflectors. Such mechanical reflectors include a cylinder that is painted half in white and half in black. When the white half is showing, substantially all incident light is reflected. When the black half is showing all incident light is absorbed. The cylinder is rotated to expose a certain proportion of white depending on the degree of reflectivity that is desired.

In professional lighting,: only the Panavision Company's "PanaLite Eye Light" fixture is known to use a variable tone reflector to control light output. The device reflects light off a series of parallel rollers that are painted half white, half black and rotated to control output. For other reflected lighting applications, bouncing the light off of a reflective surface provides the most common solution.

Color temperature is a characteristic of visible light that has important applications in photography, videography, publishing and other related fields. Chromaticity is the quality of a color as determined by its purity and hue. The color temperature of a light source is determined by comparing its chromaticity with a theoretical, heated black-body radiator. The Kelvin temperature at which the heated black-body radiator matches the color of the light source is that source's color temperature.

Film stocks and video cameras are manufactured to reproduce white with respect to certain color temperatures. For example, 3200 deg Kelvin incandescent and 5800 deg Kelvin for "daylight" are two normal settings. As a result, consistent and controllable source color temperature is key to creating appropriate images. However, consistent control can be difficult to obtain because, for example, 1) incandescent sources, if dimmed electrically, change color throughout the dimming range; 2) fluorescent fixtures are largely undimmable and have widely varying color temperatures that change over the life of the globe; and 3) household and existing sources contain widely different lamp sources.

Gaining improved control over lighting provided by a light fixture or lighting provided to a space from natural light has presented these and other challenges to lighting experts.

SUMMARY

The inventive methodology is directed to methods and systems that substantially obviate one or more of the above and other problems associated with conventional techniques for control of lighting and lighting fixtures.

Aspects of the present invention provide systems and methods that utilize the controllable reflective and translucency properties and characteristics of ePaper media for controlling light provided by a light fixture or light used for lighting of a space.

Aspects of present invention provide a system for controlling lighting of a space. The system includes a light source and a reflector. The light source is for providing an emitted light. All or a portion of this emitted light is incident on the reflector. The reflector is for receiving the incident light and reflecting the incident light as reflected light. The incident light includes at least a portion of the emitted light from the light but it may also include light from other sources that are present in the space. The reflector includes an ePaper that has controllable ePaper reflectivity. The reflector may be referred to as the ePaper reflector. By controlling the reflectivity of the ePaper reflector the lighting of the space is controlled.

In one aspect, the system also includes a baffle for blocking at least a portion of the emitted light from directly reaching the space. The baffle may also include a baffle ePaper medium that is translucent. The translucency of the ePaper baffle is also controllable to further control the lighting of the space. In one aspect, position of the baffle and light diffusion properties of the baffle are controllable to control a ratio of the reflected light to the emitted light in the space. The light source may provide light of substantially constant intensity or may include a dimmer for varying an intensity of the emitted light at the light source. In one aspect, the incident light includes direct emitted light reaching the reflector along a direct path from the light source and. indirect emitted light reaching the reflector along an indirect path from the light source. In one aspect, the ePaper reflector includes a frame, and the ePaper is installed over the frame. The flexible shape of the ePaper reflector may be controllable to control the direction of the reflected light. The degree of reflectivity may be controllable to control an intensity of the reflected light. The degree of reflectivity may be controllable substantially between 0% and 100%. The pattern of the ePaper reflector may be controllable to control a pattern of the reflected light. The color of the ePaper reflector may be controllable to control a color of the reflected light. In one aspect, the system may also include a power source for controlling the ePaper reflectivity.

Aspects of present invention also provide a method for controlling lighting of a space by controlling a light fixture. The light fixture includes a light source providing emitted light and ePaper media for controlling the emitted light. The method includes determining desired lighting in the space, adjusting lighting characteristics of the ePaper media responsive to the desired lighting, modifying the emitted light, and lighting the space. The emitted light is modified by controlling the lighting characteristics of the ePaper media to obtain a modified light that is used for lighting the space.

In one aspect, the ePaper media used in the light fixtures include an ePaper reflective medium for reflecting incident light upon the ePaper reflective medium to provide reflected light. Adjusting the lighting characteristics of the ePaper media includes adjusting reflectivity characteristics of the ePaper reflective medium responsive to the desired lighting. The ePaper media may include an ePaper baffle, and adjusting the lighting characteristics of the ePaper media may include adjusting translucency characteristics of the ePaper baffle responsive to the desired lighting.

In one aspect, the method further includes determining characteristics of the light source and adjusting the reflectivity characteristics of the ePaper reflective medium responsive to the characteristics of the light source. In one aspect, the method may further include adjusting the translucency characteristics of the ePaper baffle responsive to the characteristics of the light source. Characteristics of the light source may include an intensity of the emitted light, a color of the emitted light, a shift in the color of the emitted light with time, and an ability to dim the emitted light at the light source. To determine desired lighting, an intensity, a color, a pattern and a contribution of the light fixture to the desired lighting are determined. Adjusting reflectivity characteristics of the ePaper reflective medium may include adjusting a degree of reflectivity, a color, a pattern and one or more angles of the ePaper reflective medium. Adjusting the reflectivity characteristics of the ePaper reflective medium or the translucency characteristics of the ePaper baffle may be performed automatically by electronic instrumentation.

Aspects of present invention also provide a method for controlling lighting in a space including receiving a first light in the space, providing at least one medium including ePaper having controllable ePaper lighting characteristics, and controlling the ePaper lighting characteristics to control the lighting in the space. The medium receives an incident light that includes the first light and may include other light. The first light may include natural light and artificial light. The medium may include an ePaper reflector and reflect substantially between 0% and 100% of the incident light as a reflected light. A color and a pattern of the reflected light from the ePaper reflector would be controllable. The medium may include an ePaper translucent medium having controllable translucency. The medium may be flexible having a controllable shape. In one aspect, both the first light and the ePaper lighting characteristics are simultaneously controlled to control the lighting in the space.

Aspects of the present invention also provide a light fixture that includes a light source, a baffle, a reflector, a dimmer, a first power source, an electronic circuit and a second power source. The light source is for emitting an emitted light and for lighting a space. The baffle is for blocking at least a portion of the emitted light from directly reaching the space. The reflector is for reflecting an incident light on the reflector as reflected light, the reflector including an ePaper reflective medium having a controllable reflectivity. The dimmer is for varying an intensity of the emitted light at the light source. The first power source is for supplying power to the light source. The second power source is for writing to the ePaper reflective medium. The electronic circuit is for controlling the ePaper reflective medium. The incident light includes direct emitted light reaching the reflector along a direct path from the light source and indirect emitted light reaching the reflector along an indirect path from the light source. The reflector includes a frame for holding the ePaper reflective medium. A position of the baffle and light diffusion properties of the baffle are controllable to control a ratio of the reflected light to the emitted light in the space. The controllable reflectivity of the ePaper is controllable to control an intensity of the reflected light, effect a gross shade shift from black to gray to white, control a color of the reflected light, effect simple color shifts from full red, to yellow or green, control a pattern of the reflected light, and control a direction of the reflected light. The baffle includes translucent ePaper having controllable translucency.

Additional aspects related to the invention will be set forth in part in the description which follows, and in part will be obvious from the description, or may be learned by practice of the invention. Aspects of the present invention may be realized and attained by means of the elements and combinations of various elements and aspects particularly pointed out in the following detailed description and the appended claims.

It is to be understood that both the foregoing and the following descriptions are exemplary and explanatory only and are not intended to limit the claimed invention or their application in any manner whatsoever.

BRIEF DESCRIPTION OF THE DRAWINGS

The accompanying drawings, which are incorporated in and constitute a part of this specification exemplify the embodiments of the present invention and, together with the description, serve to explain and illustrate principles of the inventive technique. Specifically.

DETAILED DESCRIPTION

Figure 1:
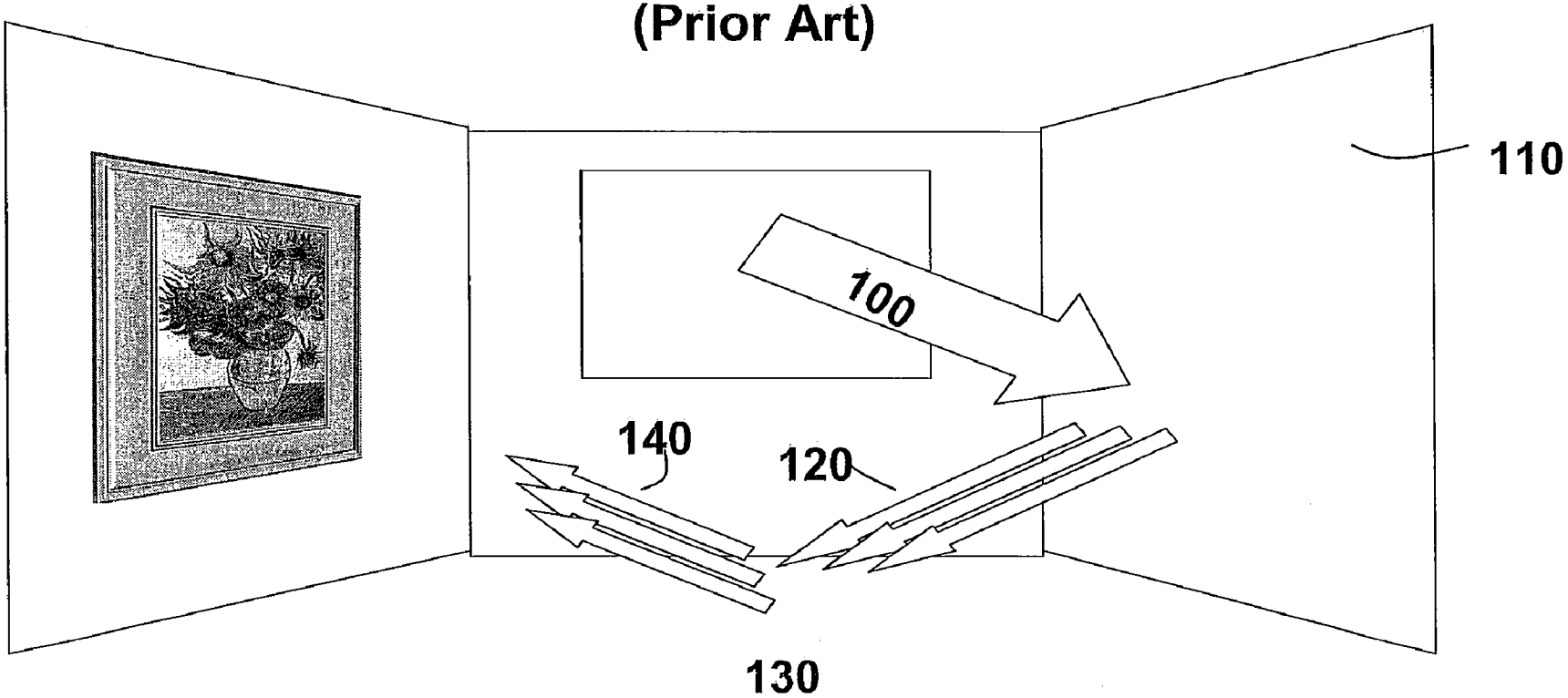
FIG. 1 (Prior Art)
FIG. 1 shows contributions of reflected light to lighting of a space.

In the following detailed description, reference will be made to the accompanying drawings, in which identical functional elements are designated with like numerals. The aforementioned accompanying drawings show by way of illustration, and not by way of limitation, specific embodiments and implementations consistent with principles of the present invention. These implementations are described in sufficient detail to enable those skilled in the art to practice the invention and it is to be understood that other implementations may be utilized and that structural changes and/or substitutions of various elements may be made without departing from the scope and spirit of the present invention. The following detailed description is, therefore, not to be construed in a limited sense. Additionally, the various embodiments of the invention as described may be implemented in the form of a software running on a general purpose computer, in the form of a specialized hardware, or combination of software and hardware.

Electronic paper, also called ePaper, is a display technology designed to mimic the appearance of ordinary ink on paper. Writing to the ePaper is a term for setting the degree of reflectivity of the ePaper and adjusting its color and pattern. ePaper is a rewritable medium that displays images like printed paper. Unlike a conventional flat panel display, which uses a backlight to illuminate its pixels, ePaper reflects light like ordinary paper and is capable of holding text and images indefinitely without drawing electricity, while allowing the image to be changed later. While one important feature is that the pixels are image stable, or bistable, so that the state of each pixel can be maintained without a constant supply of power, some forms of ePaper require some power to hold the image.

ePaper was developed in order to overcome some of the limitations of computer monitors. For example, the backlighting of monitors is hard on the human eye, whereas ePaper reflects light just like normal paper. Further, ePaper is easier to read at an angle than flat screen monitors. ePaper is lightweight, durable, and highly flexible compared to other display technologies.

A more common type of ePaper responds to two signals. One of the signals determines whether it is in an "on" state during which the ePaper is writable. The other signal determines what is being printed on the ePaper during the "on" state. For example, Fuji-Xerox's photo-addressable ePaper can only be written to when a suitable voltage is applied. When the voltage is applied, crystals in the photoaddressable layer respond to the light incident upon them at the time, turning reflective if sufficient light is reaching them or remaining transparent if light that is reaching them is insufficient. In other ePaper technologies, these signals may be of a different sort, and may be combined into one signal. It is common, for instance, for the second signal that writes the image to be electrical, where the direction of the electric field determines the reflective properties. The two signals are sometimes combined. For most ePaper technologies, the two signals are electrical and reach the ePaper via a circuit that can be controlled by a switch or a more complicated interface. How complicated the circuitry needs to be depends in part on whether sufficient flexibility is obtained by having the entire surface change together or whether more fine-grained control of different areas of the surface would be needed.

Most ePaper technologies also support some color; some of them support a wide range of colors. A pure ePaper technology requires power only when changing the image; some current ePaper technologies require a small amount of power to maintain an image; but all benefit from low or intermittent power requirements when compared to standard displays.

A number of variations of ePaper technologies are being developed that, for example, include eInk, FXphoto, Fujitsu, Nemoptic, Pol, and SiPix.

Predicted future applications of ePaper include ePaper books, magazines or labels. Books using ePaper are, for example, capable of storing digital versions of many books, with only one book displayed on the pages at any one time. ePaper posters and similar advertisements have already been demonstrated in shops and stores.

The current and predicted applications driving the development of ePaper use the ePaper as a direct display medium. In these applications, a user is looking directly at the ePaper to observe the writings or the patterns shown on the ePaper. Therefore, the current applications of ePaper are all directed to using the properties of this product only for ease of reading or viewing.

Aspects of the present invention are directed to methods and systems that provide a new use for the ePaper technology.

Aspects of the present invention are directed to methods and systems that utilize light reflected by an ePaper surface or medium or diffused through an ePaper surface or medium.

Aspects of the present invention include methods and systems that utilize the dynamically controllable reflective properties of ePaper to control light from a light fixture. In one aspect of the invention, a desirable pattern is written to the ePaper that is being used for reflecting light from a light fixture; the pattern is electrically controllable and may be dynamically modified as the lighting requirements change.

Aspects of the present invention utilize the reflective properties of ePaper for controlling the lighting in a space by controlling the reflected light in the space and provide methods and systems of using ePaper in lighting design. The easily modifiable reflective properties of ePaper enable designers to experiment quickly and easily with different effects during the design process. Aspects of the present invention further utilize the controllable translucency of ePaper media for controlling light used for lighting of a space.

FIG. 1 shows contributions of reflected light to lighting of a space.

In FIG. 1, light 100 from a light fixture or a natural light source enters the room. The light 100 is reflected by a first surface 110 resulting in first reflected light 120. The first reflected light 120 is subsequently reflected from a second surface 130 resulting in a second reflected light 140. The light 100 and any of the reflections of this light may be further reflected from walls, furniture, people, and other surfaces present in the room. A resulting light illuminating the space within the room, therefore, includes contributions from the first light 100 and all various reflections of this light.

FIG. 1 illustrates the complexity of reflection and a potential for controlling various reflections of the light in a space in order to control the resulting light.

Figure 2A:
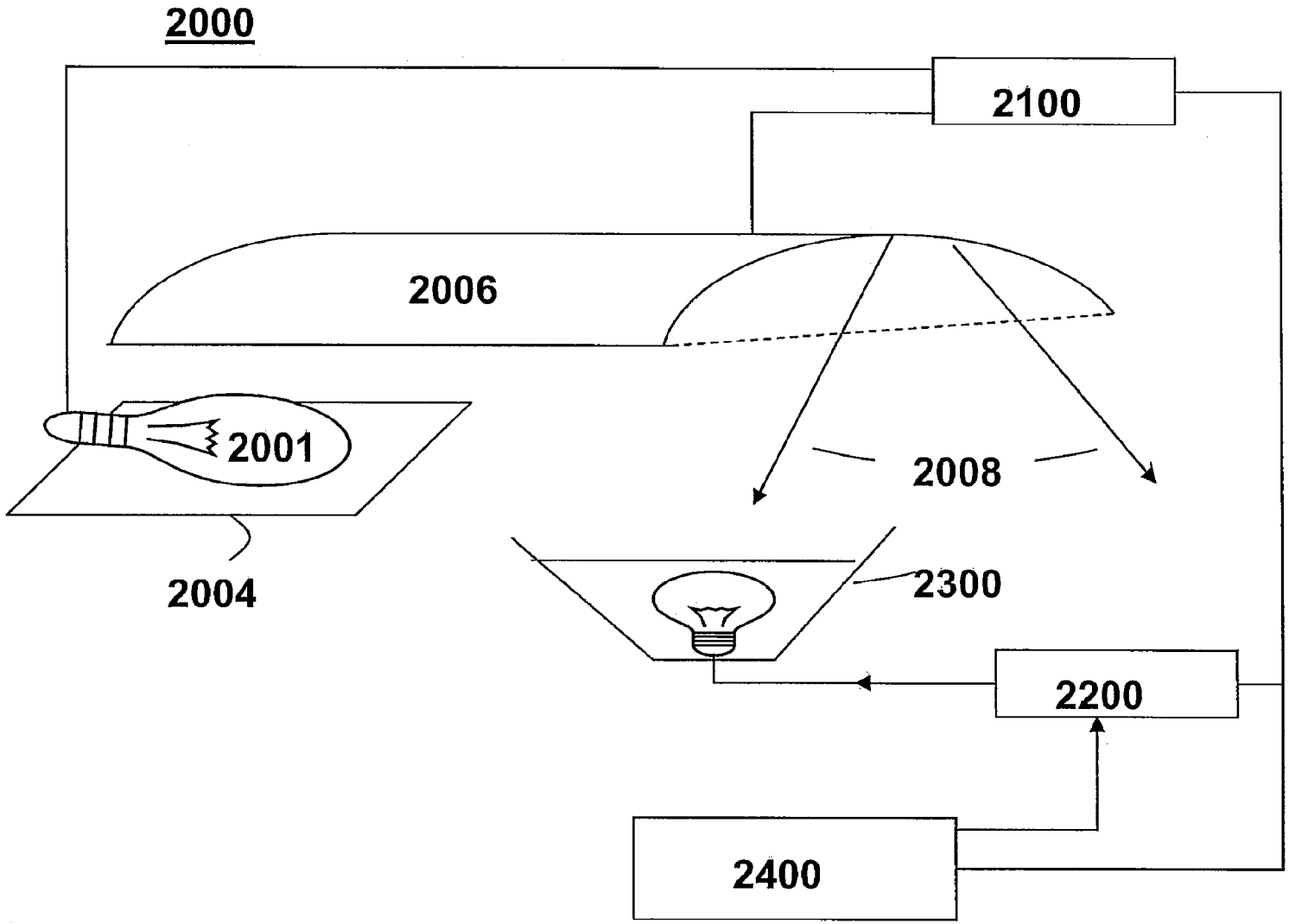
FIG. 2A shows an exemplary system for using ePaper for controlling light used for lighting of a space according to aspects of the present invention.

FIG. 2A shows a system for using ePaper for controlling light used for lighting of a space according to aspects of the present invention.

The system 2000 includes a light source 2001, a baffle 2004 and a reflector 2006. The reflector 2006 is located with respect to the light source 2001 such that it receives light from the light source 2001 directly or indirectly. The system 2000 is used to light a space 2009.

The system 2000 may also include a power source 2100, a controller 2200, a writing source 2300, and a light sensor 2400 that are further described with respect to the reflector 2006.

The light source 2001 is used to emit light. In some embodiments, the light source 2001 emits light of substantially constant intensity. In other embodiments, the intensity of the light may be varied at the light source 2001. In other words, the light source may be dimmable. The light source 2001 may emit light of one frequency or a combination of multiple frequencies.

The baffle 2004 is located between the light source 2001 and the space 2009 that is to be lit by the system 2000. In one aspect of the invention, the baffle 2004 is located with respect to the light source 2001 such that the baffle 2004 substantially blocks light from the light source 2001 from directly entering the space 2009. As such, any light in the space 2009 substantially results from indirect light from the light source 2001 or other light sources in the space that are now shown.

One of the dictionary definitions of the term "baffle" includes a flat plate that controls or directs the flow of fluid or energy. The term "baffle" in the following description is used to indicate traditional baffles used in the lighting industry as well as a portion of a light fixture that blocks all or some of the light from the light fixture.

In one aspect of the invention, the baffle.2004 may be omitted altogether or may be located with respect to the light source 2001 such that the light in the space 2009 partially results from direct light from the light source 2001 and partially from the indirect light from the light source 2001.

In one aspect of the invention, position and light diffusion properties of the baffle 2004 may be controllable to modify the proportion of the direct and indirect light from the light source 2001 that is used to light the space 2009.

The baffle 2004 is shown as a plane in FIG. 2A. However, the baffle 2004 may be semi-spherical, semi-cylindrical, in the shape of a cone or a pyramid, or a surface enclosing all but a small portion of the light source 2001.

The reflector 2006 is located on an opposite side of the light source 2001. Light incident upon the reflector 2006 is reflected from the reflector 2006 as reflected light 2008. In one aspect of the invention, the light incident upon the reflector 2006 is primarily light emitted from the light source 2001. In one aspect of the invention, the light incident upon the reflector 2006 is a combination of direct light from the light source and indirect light from the light source 2001. In one aspect of the invention, the light incident upon the reflector 2006 is a combination of direct and/or indirect light from the light source 2001 and light from other light sources.

The reflector 2006 may be formed to fit a particular shape appropriate for a particular application. In one aspect, the reflector 2006 may be mounted on a rigid surface in order to maintain its shape in the system 2000. The reflector 2006 is shown as a semi-cylindrical surface in FIG. 2C. However, the reflector 2006 may be semi-spherical, in the shape of a cone or a pyramid, or simply planar.

In one aspect, the reflector 2006 may be maintained in a flexible state and the shape of the reflector 2006 may be manipulated according to the particular application. Changing the shape of the reflector 2006 changes the angles of incidence and reflection from the reflector 2006 and therefore changes the direction of the reflected light.

The reflector 2006 may be formed from a reflective medium or a reflective surface alone. The reflector may be formed from a reflective medium attached or mounted on a frame. In this alternative, the frame may be rigid or flexible. The flexible shape of the reflector 2006 or the frame may be capable of being mechanically controlled.

The light source 2001 may be a fluorescent light source, an incandescent light source, a light emitting diode (LED), or any other light source capable of emitting visible light.

The baffle 2004 may be formed from a light absorptive material or from a reflective or partially reflective material. The baffle 2004 may be formed from a translucent material that diffuses or regulates light. One aspect of the present invention including a translucent baffle with a controllable translucency is shown and described in FIG. 2B.

The reflector 2006 is formed from different varieties of ePaper. Many types of ePaper are flexible. As such, the reflector 2006 may be flexible unless mounted on a rigid frame. By changing the flexible shape of the reflector 2006, angles of incidence and therefore reflection may be modified and dynamically or statically controlled. For example, if a crumpled ePaper reflective medium is used, the reflections of a light incident in a single direction occur in many different directions and result in a diffused effect.

ePaper may be controlled to retain different patterns and colors. Further, a degree of reflectivity of the ePaper may also be controlled to vary from substantially 0% to substantially 90% or more. At 0% reflectivity, ePaper operates like a black surface absorbing all incident light. At a high degree of reflectivity, ePaper operates like a mirror reflecting most of the incident light. The color and pattern of the ePaper impact the reflected light. Direction, relative intensity, color, and any pattern of the reflected light may all be controlled by controlling the ePaper used in the reflector 2006.

Controlling the ePaper may be done by writing a color or a pattern to the ePaper or by writing a desirable combination of white and black to the ePaper to control the degree of reflectivity from the ePaper. The power source 2001 may be used to turn on the ePaper and prepare it for being written to. The power source 2100 may also be connected to the light source.2001. The light source 2001 may alternatively have a separate power source. The controller 2200 is used to control a writing source 2300 that is used to write to the ePaper. In some types of ePaper, writing to the ePaper is performed by using a light source that shines onto the ePaper. The light sensor 2400 may be used to sense the light in the space 2009 and report the sensed light to the controller.

Further, the baffle 2004 may also be formed from ePaper with controllable translucency. Controlling the lighting by controlling the translucency of the baffle is described further with respect to FIG. 2B.

As described below, with respect to FIG. 2C, by controlling the ePaper used in the reflector 2006, the light reflected from the reflector 2006 and provided to the space 2009 may be controlled. In the aspects shown in FIG. 2C one or both of the reflector and the baffle may be made of ePaper and their reflectivity and translucency may be controllable.

Figure 2B:
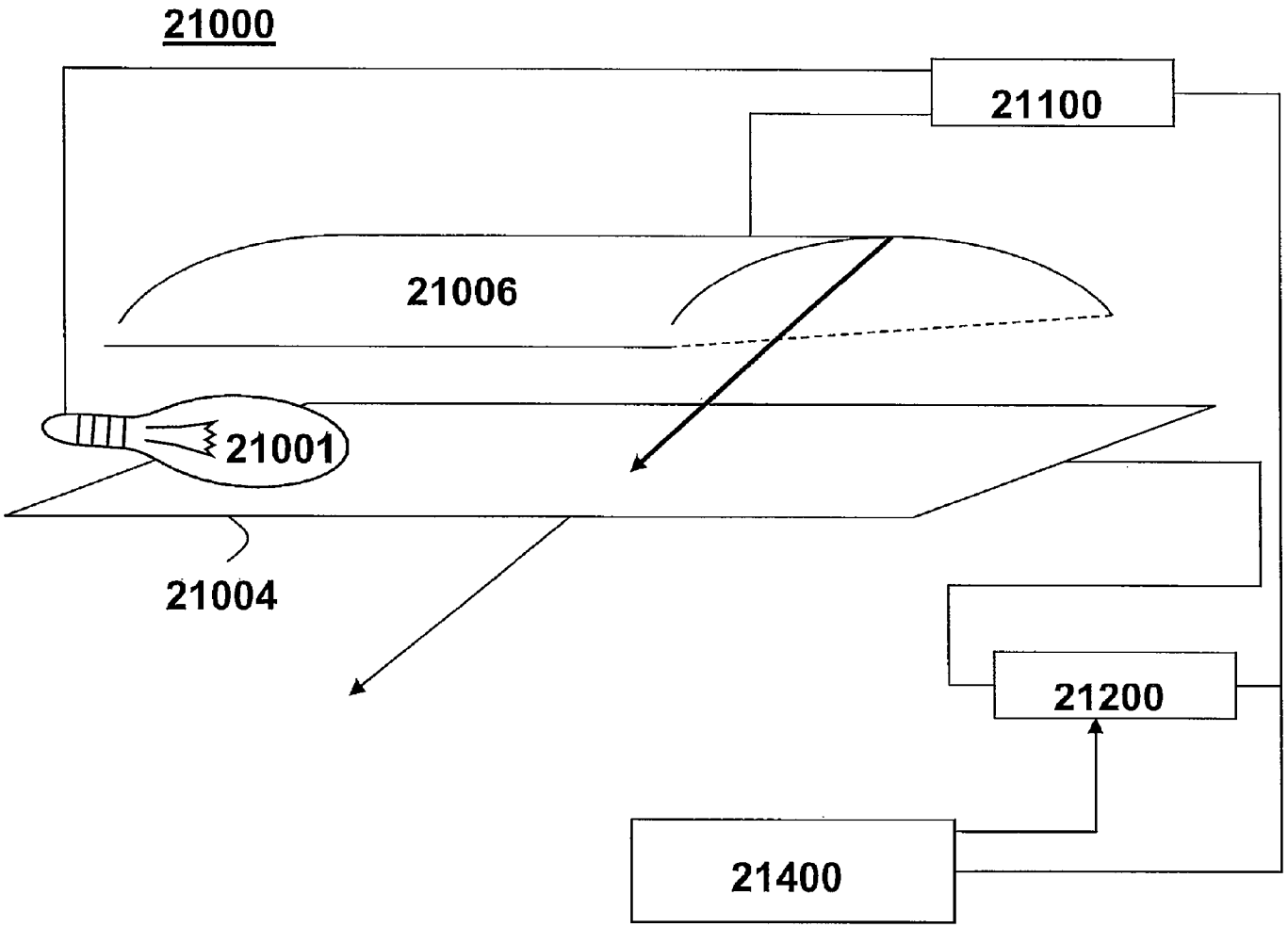
FIG. 2B shows another exemplary system for using ePaper for controlling light used for lighting of a space according to aspects of the present invention.

FIG. 2B shows an exemplary application of translucency properties of ePaper for controlling light from a light fixture according to the aspects of the present invention.

Translucency of some types of ePaper is also controllable and may be utilized in controlling the light provided by a light fixture or light permitted into an architectural space. FIG. 2B is a variation of the system shown in FIG. 2A where controlling the translucency and emissive properties of an ePaper medium are used for controlling light. The system of FIG. 2B includes the light source 21001 and an ePaper baffle 21004 and may also include the reflector 21006. The system may also include the power source 21100, the controller 21200 and the light sensor 21400. The light source 21001 is used to emit light. The ePaper baffle 21004 is located between the light source 21001 and the space that is to be lit such that the ePaper baffle 21004 substantially blocks light from the light source 21001 from directly entering the space. The ePaper baffle 21004 is coupled to the controller 21200 such that a translucency of the ePaper medium forming the ePaper baffle 21004 may be controlled. In one aspect of the invention, light diffusion properties of the baffle 21004 are controllable to modify the light from the light source 21001 that is used to light the space. Because ePaper is flexible, a shape of the ePaper baffle 21004 may also be controlled.

Figure 2C:
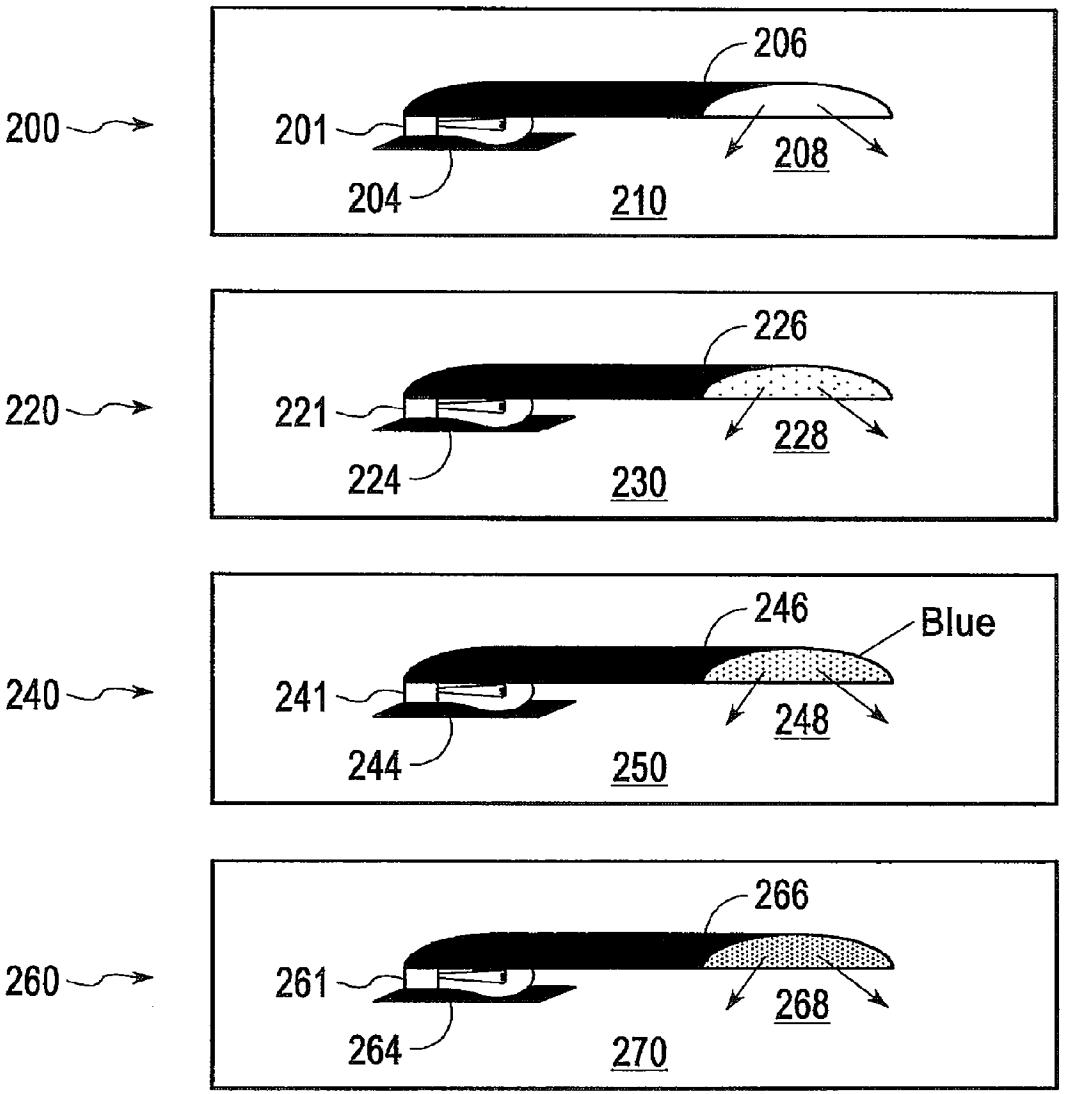
FIG. 2C shows a number of settings or systems for using ePaper for dimming light or changing the color, pattern, or direction of light according to aspects of the present invention.

FIG. 2C shows a number of settings or systems for using ePaper for dimming light or changing the color, pattern, or direction of light according to aspects of the present invention.

FIG. 2C includes settings 200, 220, 240 and 260. Various settings of the system 2000 of FIG. 2A may be shown as settings 200, 220, 240 and 260. Alternatively, each of the settings shown may be a separate system that is a separate light fixture. So each of 200, 220, 240 and 260 may be either a setting of the system 2000 of FIG. 2A or FIG. 2B or a separate independent system.

The system 200 includes a light source 201, a baffle 204 and a reflector 206. The reflector 206 is located with respect to the light source 201 such that it receives light from the light source 201 directly or indirectly. The system 200 is used to light a space 210. In system 200, the reflector 206 is selected to reflect a large percentage of the light incident on the reflector 206 without changing the color of the light. For example, 90% of the light emitted by the light source 201 and incident on the reflector 206 may be reflected toward the space 210 by the reflector 206.

System 220 includes a light source 221, a baffle 224, a reflector 226 and reflected light 228 reflecting off of the reflector 226 to light a space 230. In system 220, the reflector 226 is selected to reflect some percentage of the light incident on the reflector 226 without changing the color of the light. For example, 50% of the light emitted by the light source 221 and incident on the reflector 226 may be reflected toward the space 230 by the reflector 226.

System 240 includes a light source 241, a baffle 244, a reflector 246 and reflected light 248 reflecting off of the reflector 246 to light a space 250. In system 240, the reflector 246 is selected to reflect some percentage of the light incident on the reflector 246. For example, 50% of the light emitted by the light source 241 and incident on the reflector 246 may be reflected toward the space 250 by the reflector 246. In system 240, the reflector 246 receives a white light from the light source 241 but reflects only the blue portion of the incident light such that the reflected light 248 is blue in color. The color blue is exemplary. The reflector 246 may be controlled or preset to reflect only a certain frequency or frequencies of the incident light. The combination of the reflected frequencies determines the color of the reflected light 248.

System 260 includes a light source 261, a baffle 264, a reflector 266 and reflected light 268 reflecting off of the reflector 266 to light a space 270. In system 260, the reflector.266 is selected to absorb all of the light incident on the reflector 266. When 0% of the light emitted by the light source 261 and incident on the reflector 266 is reflected, the space 250 receives no light from the reflector 246 and remains dark unless direct light from the light source 261 is otherwise available in this space or unless some other light source is providing light.

The systems 200, 220, 240 and 260 may be different systems that are preconfigured.

Alternatively, the same system 2000 may be controlled to perform like each of the described systems depending on the desired lighting. In the dynamically controllable system 2000, the reflectivity properties of the reflector 2006 are dynamically controlled and modified to change the intensity, color, patterns and direction of lighting in the space 2009.

In one aspect of the above systems 200, 220, 240 and 260 or the dynamically controllable system 2000, the light source is not an emitting source; rather it includes light reflected from another body.

The systems 200, 220, 240 and 260 are used to set the reflectivity including the degree of reflectivity, color, pattern and angle of the reflector and determine the intensity, color, pattern and direction of the reflected light. The dynamically controllable system 2000 is used to dynamically change and control the intensity, color, pattern and direction of reflection of the reflected light.

Altering a lighting fixture's reflective medium is easy compared to conventional light fixtures, whether the systems 200, 220, 240 and 260 are used or if the dynamically controllable system 2000 is used. Either type provides the ability to dim or recolor light from a lighting fixture without the need to manipulate the light source itself. Either type provides the ability to dim or recolor reflected sunlight off surfaces that would otherwise, and without using ePaper, have fixed reflectivity.

Further, while the baffles in FIG. 2C are shown as blocking only the direct light from the light source, similar to the set up shown in FIG. 2A, the baffles may be similar to the set up of FIG. 2B where substantially all of the light reflected from the reflective surface goes through the ePaper baffle and the translucency of the baffle is controlled to control the light being provided by the light fixture.

Use of ePaper as the reflective medium in the lighting fixtures of the embodiments of the invention, provide lighting designers with the flexibility to control the surface off which the light is reflected in addition to conventional controls over the light source itself by using dimmers, globes, type, and the like.

For example, fluorescent lamps cannot be reliably dimmed and are difficult to recolor on-site and tungsten halogen globes run at peak efficiency within a narrow voltage range. With such light sources, where control of the emitted light is not convenient, the ePaper reflective medium can economically enhance light control.

Figure 3:
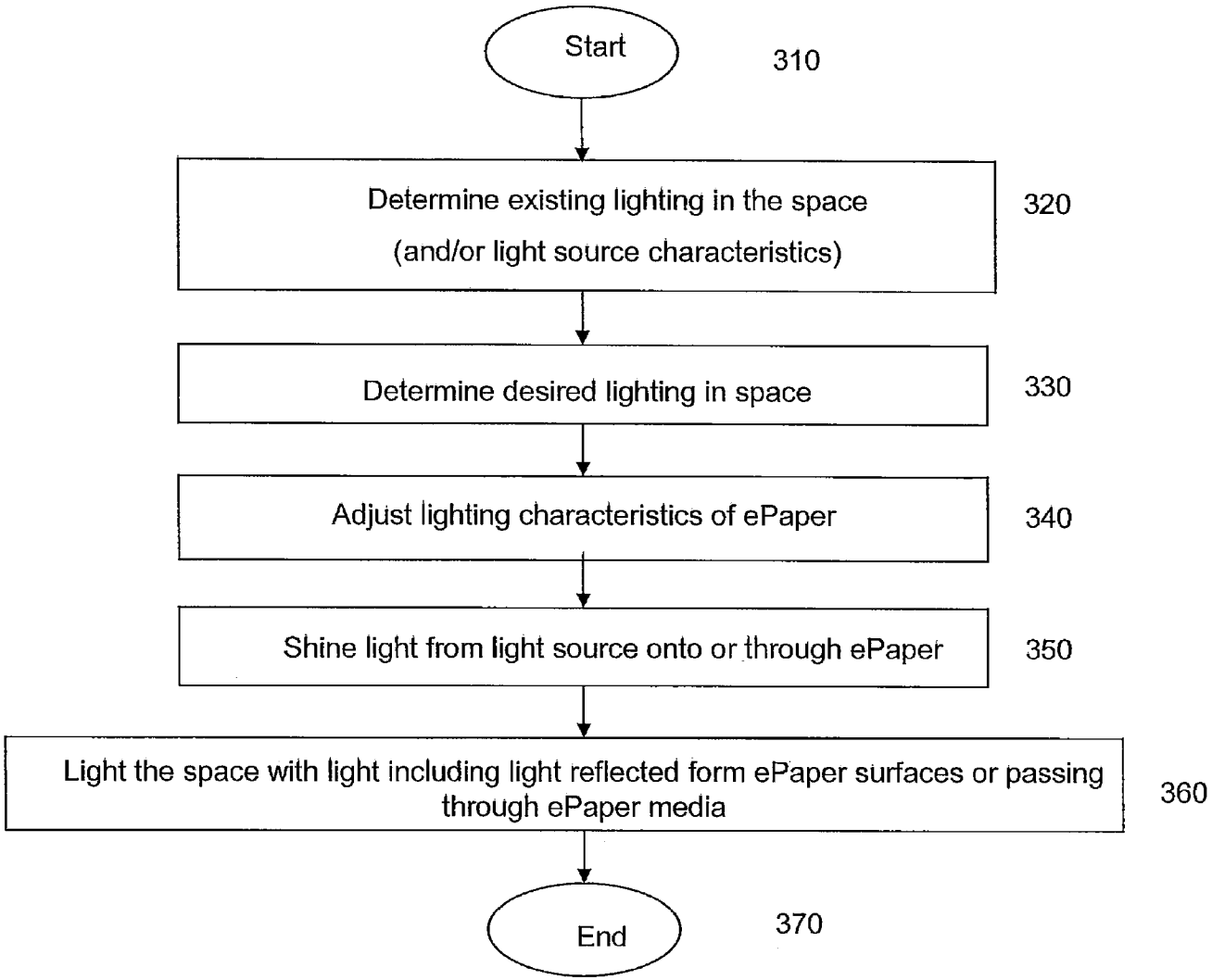
FIG. 3 shows a flow chart of a method of using ePaper for changing lighting characteristics of a light fixture according to aspects of the present invention

FIG. 3 shows a flow chart of a method of using ePaper for changing the intensity, color, pattern or direction of reflected light in a light fixture or for changing other lighting characteristics of the light fixture according to aspects of the present invention.

The method starts 310. Then, the existing light in a space to be lit is determined 320. Then desired lighting in the space to be lit is determined 330. Then, ePaper's lighting characteristics are adjusted according to the current light and the desired lighting 340. Then, light from the light source is shone onto the ePaper 350. Then, the space is lit with light including light reflected from or passing through the ePaper media whose lighting characteristics are being controlled 360. The method or process then ends 370.

At 320, when determining the existing light in the space, the method may determine intensity of light. The color of the exiting light may also be determined.

In one aspect, instead of determining the characteristics of the current lighting in the space at 320, characteristics of a light source used in the light fixture may be determined. In that case, reflectivity characteristics of the ePaper are adjusted according to the light source characteristics and the desired lighting.

When determining the characteristics of the light source used in the light fixture, the method may determine the intensity of light emitted from the light source. The color of the emitted light may also be determined. At some light sources, the frequency of the emitted light shifts as the light source ages. The frequency or frequencies of the emitted light may be determined. The emitted light may or may not be dimmable at the light source. The ability to dim the light at the light source may also be determined.

At 330, when determining desired characteristics of the light in the space to be lit by the light fixture, one, some or all of intensity, color and pattern of light desired for lighting the space are determined. The space may be a living space, a photography set, or a film stage. The space may be receiving some natural light or light from other light sources. Various parameters may be taken into consideration when determining the characteristics of the light in the space and the contribution of the light to be provided by the light fixture.

At 340, the parameters obtained from determining characteristics of the existing light and the characteristics of the desired light are used to adjust and set some or all of degree of translucency, degree of reflectivity, color, pattern, or direction of the ePaper reflective medium or ePaper baffle used in the light fixture or in conjunction with the light fixture. This may operate like a feedback loop regulating the light being reflected by the ePaper reflective medium or passing through an ePaper baffle. The existing light is fed back to adjust the translucency and reflectivity parameters of the relevant ePaper media and arrive at the desired light.

Alternatively, at 340, if characteristics of the light source have been determined, then the characteristics of the light source and the characteristics of the desired light with or without the characteristics of the existing light may be used to adjust and set the reflectivity parameters.

When the characteristics of the light fixture are used, once the parameters defining the desired light in the space to be lit and the parameters defining the light fixture are determined, the parameters defining the reflectivity of the ePaper reflective medium may be determined. The ratio of the light energy or power reflected from the ePaper to the light energy or power incident on the ePaper, the color of light reflected from the ePaper, the pattern of the reflected light, and the direction of the reflected light may be determined. Contributions of light from all sources are considered in determining the reflectivity parameters of the ePaper. When a translucent ePaper baffle is used, other lighting characteristics of the ePaper medium, such as its translucency characteristics may also be determined.

For example, if the color of the emitted light has changed because the light source has aged, the color of the ePaper is adjusted to compensate for the shift in the color frequency of the light source. Also, if the light source is determined not to be dimmable at 320, then at 340, the reflectivity of the ePaper is adjusted by writing more or less white or black to the ePaper to dim the light that ends up lighting the space.

At 350, the light from the light source may be shone onto the ePaper reflector either directly or indirectly. A combination of both direct light from the light source and one or more reflections of the direct light may be shone onto the ePaper. With an ePaper baffle, a combination of the light from the light source and the light reflected from the reflective medium may pass through the ePaper baffle having a variable and controllable translucency.

At 360, the light used for lighting the space may be limited to only light reflected from the ePaper or may include both this reflected light and other direct or indirect light from the light source in the light fixture. The light fixture may be such that it blocks all light from the light source except for light directed toward the ePaper reflective medium. The relative positioning of the light source and the space to be lit may be such that only light reflected from the ePaper reaches the space.

Further, if several ePaper surfaces or media are being used for various purposes, the relevant characteristics of each ePaper surface or medium are determined. For example the reflectivity characteristics of the ePaper reflective surface and the translucency characteristics of the ePaper baffle that is located between the light source and the space being lit are determined and controlled.

The stages of the flow chart of FIG. 3 may be determined and performed manually by an operator or may be determined and performed automatically by using appropriate instrumentation. Sensors may be used to determine light characteristics. A computer program may be used to determine the desired angle and other reflective properties of the ePaper reflective medium. Electronic circuits and mechanical motors may be used to set the degree of reflectivity, color, pattern and angle or angles of the ePaper.)

Figure 4:
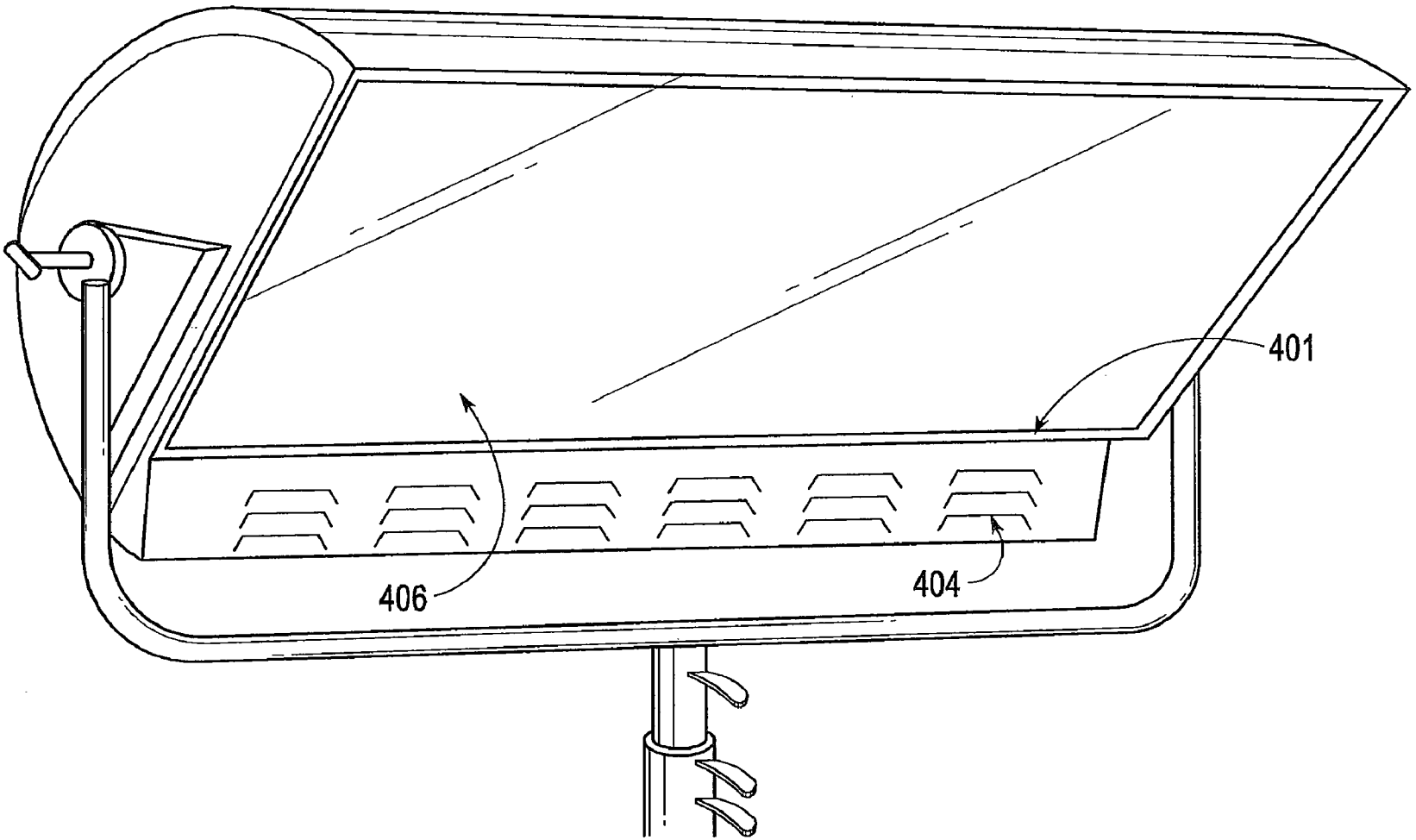
FIG. 4 shows a professional soft light system including a reflective ePaper surface according to aspects of the present invention.

FIG. 4 shows a professional soft light system including a reflective ePaper surface according to aspects of the present invention.

The system of FIG. 4 includes a light source 401, a light cover or baffle 404 and a reflector 406. The light source 401 may be a recessed light source that is recessed within the cover 404. Light from the light source 401 is partially blocked by the cover 404 and partially directed toward the reflector 406. The reflector 406 is formed from one of the varieties of ePaper. The intensity of reflected light and the color and pattern of reflected light may be controlled by controlling the ePaper reflector 406. The angle of the reflector 406 may also be changed to control the direction of reflected light. The reflector may be deformed in a variety of shapes to reflect light that is incident in a single direction in several different directions at the same time. Changing the degree of reflectivity, color, pattern and angle or angles of the reflector 406 may be performed statically between applications or dynamically during each application.

Figure 5:
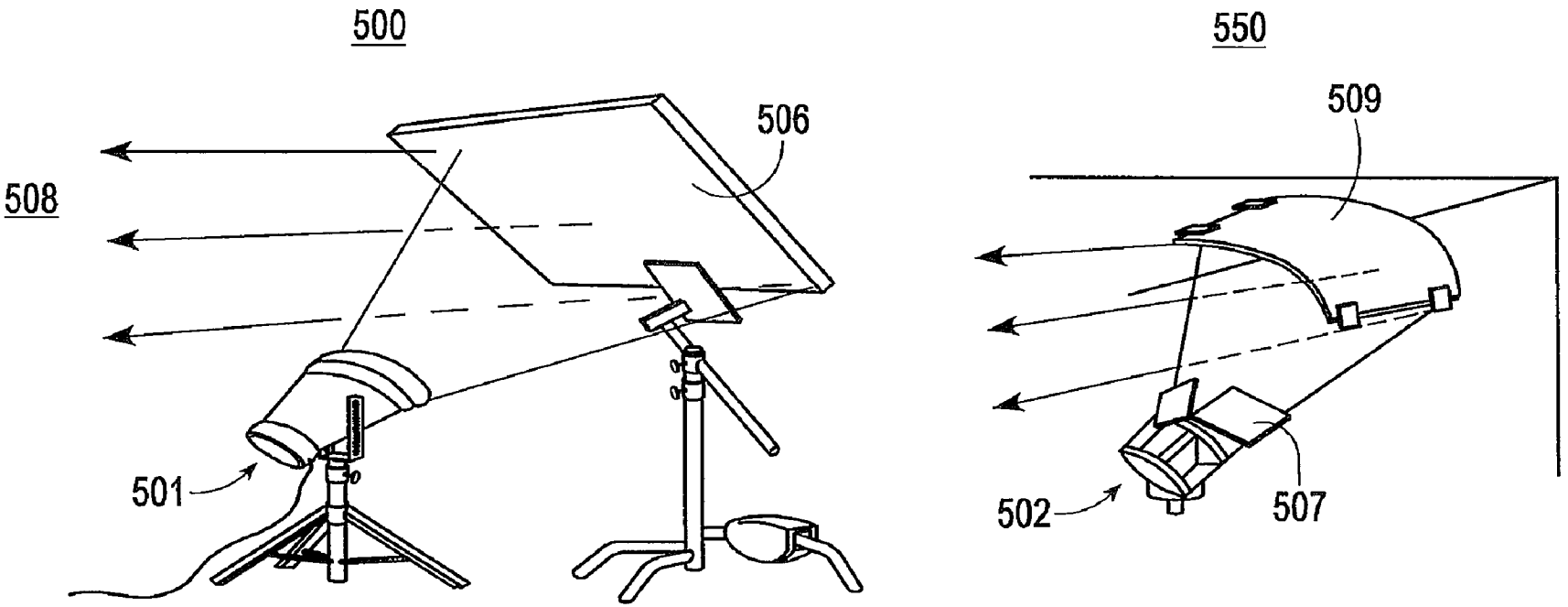
FIG. 5 shows bounce set up systems including a reflective ePaper surface according to aspects of the present invention.

FIG. 5 shows bounce set up systems each including a reflective ePaper surface according to aspects of the present invention.

FIG. 5 includes bounce set up systems 500 and 550. The bounce set up 500 includes a light source 501 and a reflector 506. The reflector 506 includes an ePaper reflective medium. Light from the light source 501 shines at the ePaper reflector 506 and is subsequently reflected as reflected light 508. The proportion of the reflected light to the incident light, the color and pattern of the reflected light 508 and the direction or directions of the reflected light may be controlled by controlling the ePaper reflector 506.

The bounce set up 550 includes a light source 502, a baffle 507 and a reflector 509. The reflector 509 includes an ePaper reflective medium. Intensity, color, pattern and direction or directions of reflected light 510 may be controlled statically or dynamically by controlling the ePaper reflector 509.

In the set up 500 the reflector 506 is shown as a planar surface and in the set up 550 the reflector 509 is shown as a curved surface. However, considering that both reflectors 506, 509 use flexible ePaper as the reflective medium, the shape of the reflector may be controlled. If a rigid frame is used for the ePaper, then the reflector takes the shape of the frame and retains that shape. If no frame or a flexible frame is used, the reflector remains flexible during operation.

Figure 6:
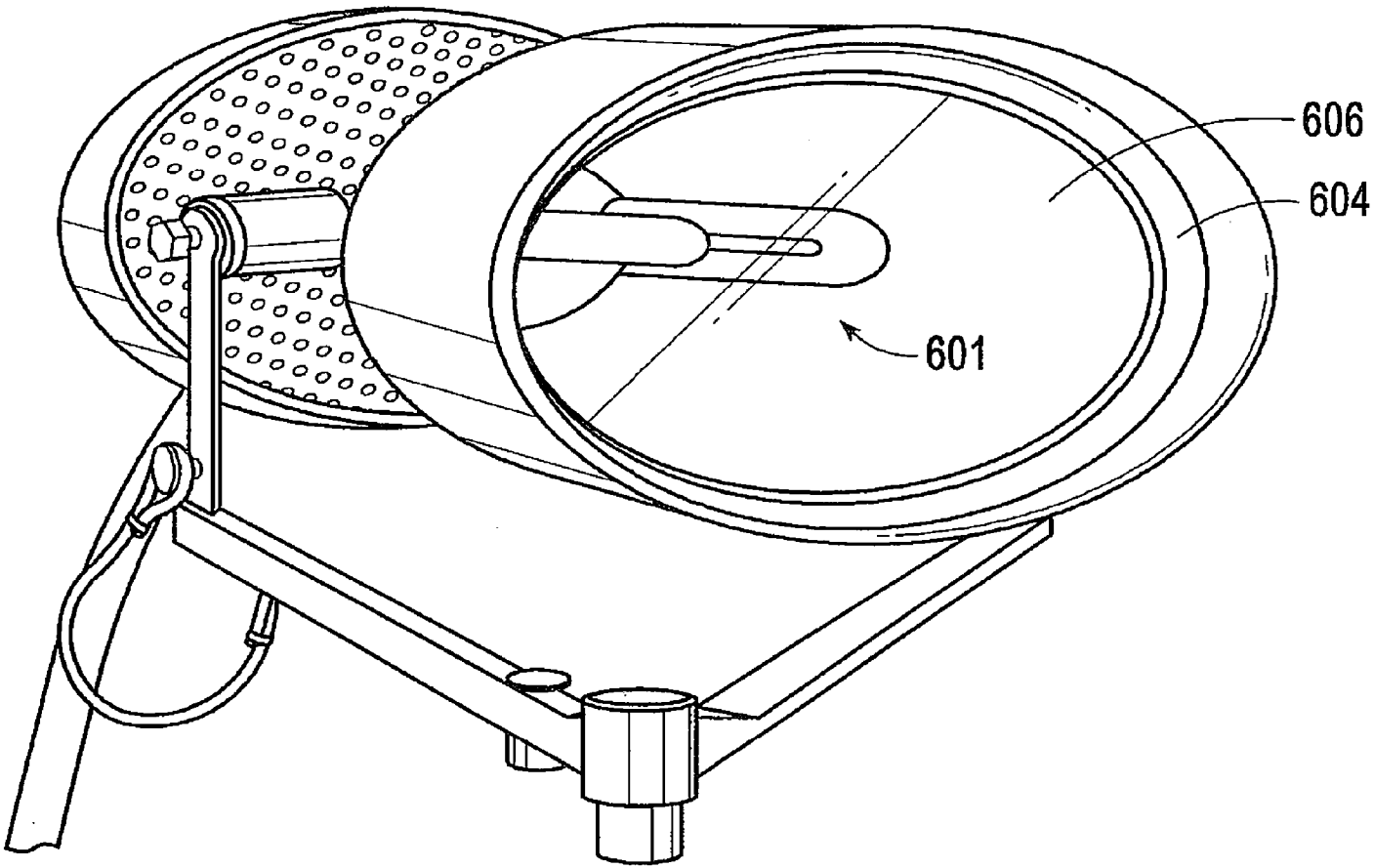
FIG. 6 shows a professional Tungsten open face lamp system including a reflective ePaper surface according to aspects of the present invention.

FIG. 6 shows a professional Tungsten open face lamp system including a reflective ePaper surface according to aspects of the present invention.

The system of FIG. 6 includes a light source 601, a baffle 604 and a reflector 606. The reflector 606 includes an ePaper surface. The light source 601 is located with respect to the reflector 606 and the baffle 604 such that the direct light from the light source 601 and the light reflected from the reflector 606 are combined and together contribute to the lighting of the space to be lit. The contribution from the reflected light may be controlled by controlling the ePaper reflector.

Figure 7:
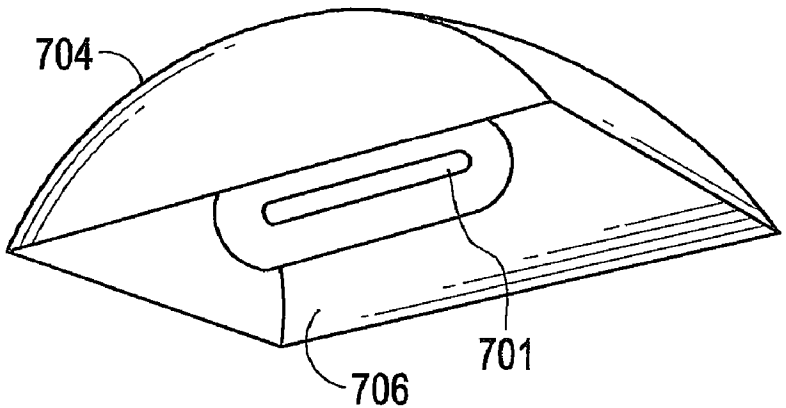
FIG. 7 shows a hydroponic specialty CFL fixture system including a reflective ePaper surface according to aspects of the present invention.

FIG. 7 shows a hydroponic specialty CFL fixture system including a reflective ePaper surface according to aspects of the present invention.

The system of FIG. 7 includes a light source 701, a housing or frame 704 and a reflector 706. The housing or the frame 704 of the light fixture operates to block the light from the light source in certain directions the same way a baffle would. The reflector 706 includes an ePaper reflective medium. Both direct light from the light source 701 and light reflected from the ePaper reflective medium contribute to the light used for lighting. The portion of the overall lighting that is contributed by the reflector 706 may be controlled by controlling the properties of the ePaper used in the reflector 706.

Figure 8:
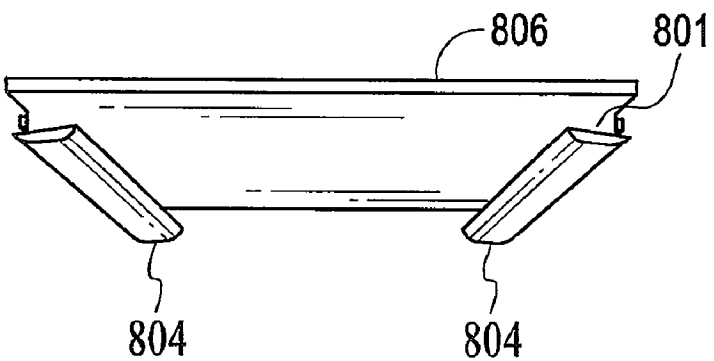
FIG. 8 shows a fluorescent indirect ceiling light system including a reflective ePaper surface according to aspects of the present invention.

FIG. 8 shows a fluorescent indirect ceiling light system including a reflective ePaper surface according to aspects of the present invention.

The system of FIG. 8 includes light sources 801, baffles 804 and a reflector 806. The reflector 806 includes an ePaper reflective medium. The baffles 804 block the light from the light source 801 that is shining toward a space to be lit. Therefore, the light shining toward the space to be lit is primarily resulting from the reflector 806. As such, controlling the properties of the reflector 806 accords significant control over the lighting of the space.

Figure 9:
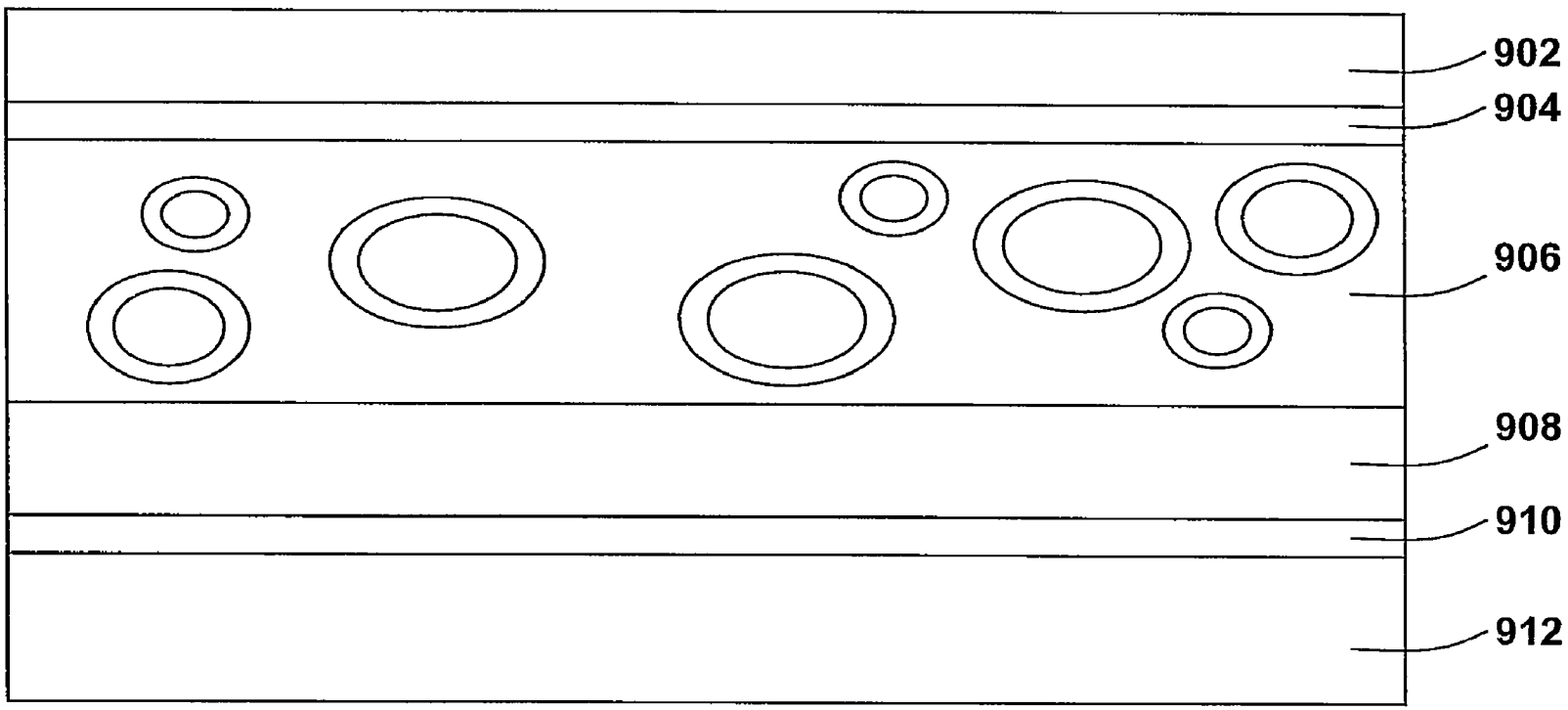
FIG. 9 (Prior Art)
FIG. 9 shows an exemplary ePaper.

FIG. 9 shows an exemplary photoaddressable ePaper. This type of ePaper will be referred to as the FX. The FX ePaper was developed by Fuji Xerox Co., Ltd. At 9-73, Akasaka Minato-ku, Tokyo 107-0052, Japan.

The FX is a photoaddressable ePaper including a film substrate 902, a first transparent electrode 904, a layer of cholesteric liquid crystal microcapsules, an organic photoconductor layer 908, a second transparent electrode 910 and a film baseplate 912. The encapsulated cholesteric liquid crystal layer 906 is sandwiched between the two transparent electrode layers 904, 910. When a voltage is applied to the electrodes 904, 910, the photoaddressable organic layer 908 changes conductivity in response to light. Illuminated regions of the ePaper become conductive, so that the adjacent liquid crystal 906 changes to another stable shape, thus fixing the illuminated regions when the voltage is removed. In one configuration, the liquid crystals reflect light so the ePaper appears white. In another configuration, the liquid crystals are transparent so whatever is below that layer can be seen. In FX's black and white ePaper technology, an all black layer is placed below the liquid crystal layer 906 so the areas in which the liquid crystals are transparent appear black. FX's photoaddressable ePaper supports multiple colors by stacking three layers that reflect different colors and are activated at different voltage levels. FX has two types of photoaddressable ePaper, one that is written from the front, and one that is written from the back.

In one aspect of the present invention, both the light source, and the ePaper reflecting surface would be attached to the same power source and to an interface that controls both the light and the reflective medium. The interface may be a switch. The interface enables users to change the reflective properties of the surface as well as turn the light on and off or dim the light. A filter may modify the light that is used to write to the ePaper to create the desired pattern on the ePaper. Alternatively, backlighting may be used to write to the ePaper.

One aspect of the present invention is implemented using photoaddressable ePaper. The ePaper reflecting surface would need to be connected to a voltage source and a switch to apply that voltage, but the writing could be done by the light from the light source itself. For example, to obtain a dark reflecting surface, the lights could be turned off while the voltage is applied, or to obtain a highly reflective medium, the lights could be put on as bright a setting as possible for the brief moment the voltage is applied. Photoaddressable ePaper changes contrast in response to the amount of incident light, but only when a suitable voltage is applied. An image can be captured by exposing different regions of the ePaper to greater or lesser illumination, similar to printing a photographic image using a conventional photosensitive emulsion. "Printing" on this medium requires both a source of variable illumination and a voltage source.

In another embodiment, the present invention may utilize certain varieties of ePaper that are written by shining light onto the front surface of the ePaper that is subsequently viewed by a user. Other embodiments may use other varieties, which are designed to be illuminated by light from behind. Further, there are other varieties that do not receive light from behind and rather include particles analogous to film grains that change their color or opacity in response to an electrical charge from a substrate grid. Electronic ink is another proprietary type of ePaper developed by the E-INK Corporation, 733 Concord Avenue, Cambridge, Mass. 02138, that is processed into a film for integration into electronic displays. This type of ePaper will be referred to as the E-Ink ePaper. The E-Ink ePaper includes millions of microcapsules. In one example, each microcapsule contains positively charged white particles and negatively charged black particles suspended in a clear fluid. When a negative electric field is applied, the white particles move to the top of the microcapsule where they become visible to the user. This makes the surface appear white at that spot. At the same time, an opposite electric field pulls the black particles to the bottom of the microcapsules where they are hidden. By reversing this process, the black particles appear at the top of the capsule, which makes the surface appear dark at that spot. To form an E-Ink electronic display, the ink is printed onto a sheet of plastic film that is laminated to a layer of circuitry. The circuitry forms a pattern of pixels that can then be controlled by a display driver. The microcapsules are suspended in a liquid carrier medium allowing them to be printed using existing screen printing processes onto virtually any surface, including glass, plastic, fabric and even paper.

Using the FX ePaper or another type of ePaper as the reflective medium in the embodiments of the present invention, allows the reflective medium used for lighting to be changed rapidly and adaptively, without the requirement for swapping in and out of materials. Embodiment of the present invention use ePaper's modifiable reflective properties to make quick lighting adjustments. Further, the use of ePaper embodiments of the present invention enables more fine grained control than supported by other known mechanisms.

Utilizing the embodiments of the present invention, light from a light fixture may be dimmed and its color may be controlled. ePaper reflectors would allow for subtle control over light sources that include incandescent sources, that if dimmed electrically, change color throughout the dimming range; over fluorescent fixtures that are virtually undimmable and have widely varying color temperatures that change over the life of the globe; and over household sources that contain widely different lamps.

Photographers and motion picture and video professionals comprise a sophisticated potential user base for reflective ePaper lighting surfaces. These professionals require fine control over the intensity, spectrum, and color temperature of their light sources. The typical professional lighting kit includes Fresnel-lensed lights, open face lamps and a variety of fluorescent, Hydrargyrum Medium Arc-length Iodide (HMI) lamps, ceramic globes, and the like. The light fixture into which the lamp is mounted plays an important role in the characteristics of the light provided by the light fixture. Both the lamp lens and the fixture's reflective surfaces impact the light provided by the light fixture. Regarding the lens, the type of lens or absence of a lens impact the light provided by the light fixture. Regarding the reflective surfaces, the intensity and color spectrum generated by the fixture's reflective surfaces impact the light provided by the light fixture.

One aspect of the present invention provides a method of using ePaper in office situations, for example, for lighting conference rooms. Many conference rooms have a number of settings for different lighting configurations in the room and an interface for choosing among them. Using ePaper reflective media in the light fixtures of such conference rooms permits a fine level of control over the lighting of the room without the need to use a different light source for each different purpose.

In one aspect of the present invention, a lookup table of patterns and colors may be provided and a desired pattern that is selected by a user is subsequently written to the ePaper.

One aspect of the present invention provides a method to be used by high end consumer lamps. These lamps may be provided with one or more ePaper reflective surfaces and may make use of the modifiable properties of ePaper to provide adjustable reflective surfaces that could soften or brighten the light or change the color. The color of the light may, for example, be changed from bluish to pinkish. Additionally, adjustment of lighting through ePaper's reflective properties can be useful in a wide range of specialty applications such as aquarium lighting, military uses in submarines and in night fighting helicopters, or hydroponic farming.

One aspect of the present invention compensates for aging in a light source. In some light sources, the frequency of the emitted light shifts as the light source ages. Frequency determines color and a shift in frequency changes the color of the emitted light from the light source. The frequency of the emitted light may be determined and compared versus the desired frequency of emission. Reflectivity of an ePaper reflective surface used in conjunction with the light source may be adjusted by feedback instrumentation. The reflected light may be a frequency shifted version of the incident light that originates from the light source such that the frequency of the reflected light is closer to the frequency of a new light source. If a baffle is used to block direct light from the light source from lighting the space, then the light used to light the space will be substantially the frequency corrected reflected light.

One aspect of the present invention includes gross shade shift or simple color shifts using ePaper reflective surfaces. Gross shade shift includes changing the shade from black to gray to white. Simple color shift, for example, includes shifting the color from full red, to yellow or green. ePaper may be used as the reflective media in lighting fixtures or other light enhanced applications in order to dim and color shift the emitted light.

The foregoing described the use of ePaper reflective properties in light fixtures. ePaper requires a power source, either temporary or permanent, to set shade or color value. When used in light fixtures, the same power source may be used to provide energy both to the light source in the light fixture and the ePaper reflective medium. Alternatively, the ePaper may have its separate power source.

In an alternative aspect of the invention, ePaper may be used to cover the walls and other surfaces in a space in order to control the overall light in the space. Aspects of the present invention enable the reflective properties of reflective media to be changed and consequently provide a wider variety of lighting configurations.

Figure 10:
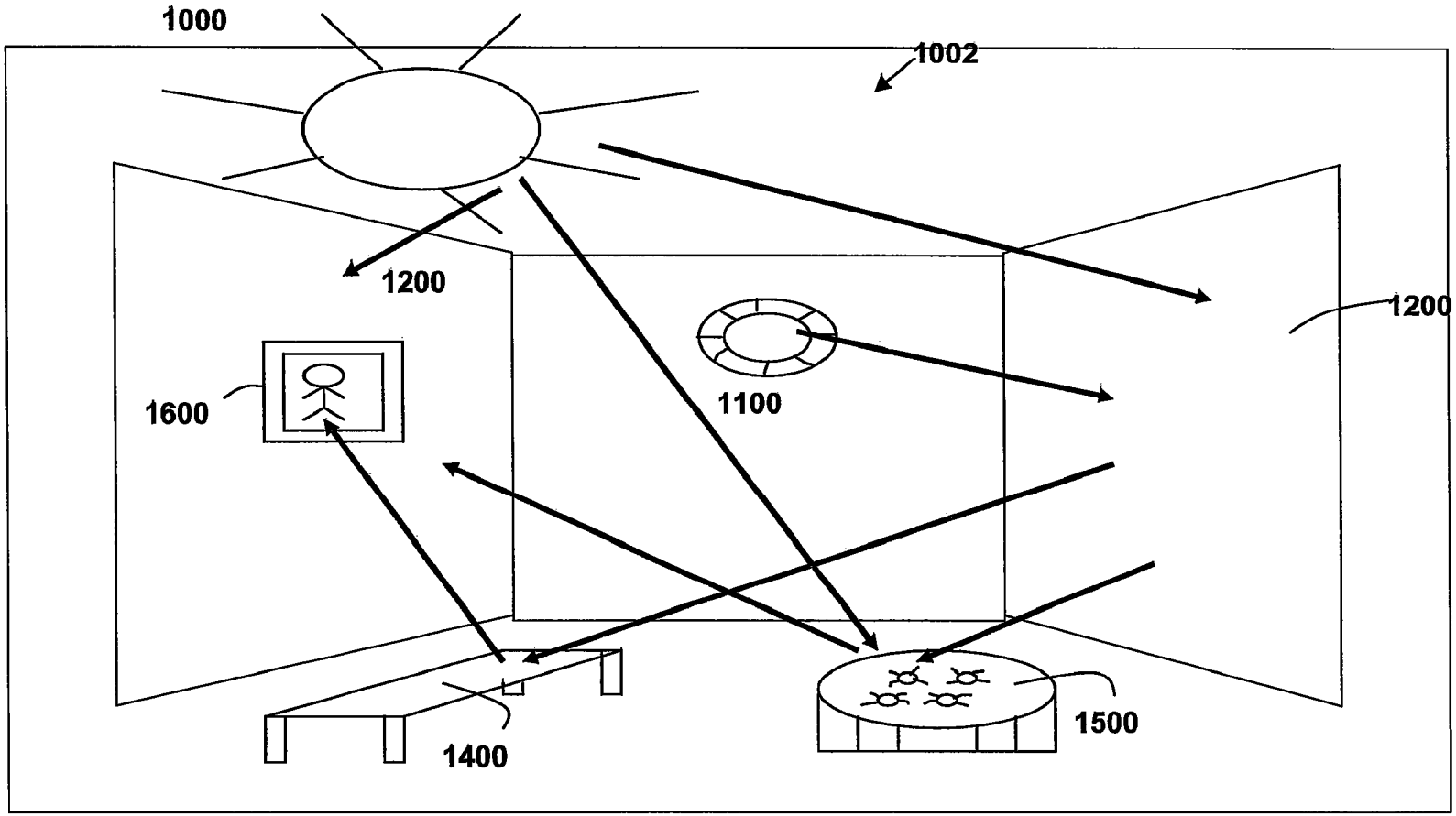
FIG. 10 shows an exemplary application of ePaper for controlling light in an architectural space according to the aspects of the present invention.

FIG. 10 shows an application of ePaper for controlling light in an architectural space according to the aspects of the present invention.

In FIG. 10, natural light 1000 shines into the architectural space 1002 and reaches surfaces of walls 1200, and furniture 1400, 1500, 1600 either directly or after being reflected from another surface. The natural light 1000 may be augmented by the artificial light 1100 from a lighting fixture. Some or all of the wall and furniture surfaces of the spaced 1002 may be covered with or may include ePaper reflective material. As such, the reflectivity from these surfaces may be controlled by controlling the ePaper covering each surface. When the ratio of reflected light to the total light is large, changing the amount of reflected light impacts the lighting in the room.

When an architectural space is lit using natural light, adjusting and controlling the reflective properties of the ePaper in such a space can improve the manner in which the space utilizes the natural light. The ePaper reflective surfaces may act as a limiting reflector during peak sun, and increase the degree of reflectivity as the sun fades. The reflectivity of the ePaper wall coverings may be adjusted by a user. Further, control may be achieved automatically using feedback from a light sensor or time of the day from a look up table or a GPS system that determines the time from the location.

This aspect of the present invention provides a method for architects to experiment with a variety of lighting effects and to create novel lighting for spaces. In the novel lighting methods both artificial and natural light are modifiable without having to include shades depriving the space from its view to the outside.

In large quantities or sheets, ePaper light reflectors can be used as a variable tone or color reflective medium for walls or other surfaces that are exposed to light levels and where it is desirable to control the intensity of reflected light. Examples include situations where reflected sunlight exposes objects such as art and furniture to damaging radiation. If the intensity of reflected light is controlled, art and furniture in the room may be better protected from damaging sunlight. The contribution of reflected light to the total light in a space may be substantial. Therefore, as sunlight varies over the course of a day, the reflective wallpaper may change reflectivity and adjust the total amount of light in the room.

In one aspect of the invention, ePaper reflective surfaces may be used in amusement parks to control the lighting in a space according to user feedback.

In one aspect of the invention, light fixtures used for lighting a conference room may be equipped with ePaper reflective media. A same switch may be used to control both the light emitted from the light source and the reflectivity of the ePaper reflective medium to ultimately control the lighting of the room.

Lighting characteristics of a medium include its reflectivity and translucency as well other characteristics.

In optics, reflectivity is the fraction of incident radiation reflected by a surface. Reflectivity is a directional property that is a function of the reflected direction, the incident direction, and the incident wavelength. Yet, in some instances it is averaged over a reflected hemisphere. Further, in some literature, reflectivity is distinguished from reflectance. When reflection occurs from thin layers of material, internal reflection effects can cause the reflectance to vary with surface thickness. Reflectivity is defined as the limit value of reflectance as the surface becomes thick. So, reflectivity is the intrinsic reflectance of the surface that does not depend on other parameters such as the reflectance of the rear surface. Reflectance is the ratio of the energy of reflected to incident light from a reflective medium.

In the foregoing written description, the term "reflectivity" is used to indicate various properties of a reflective medium that include a degree of reflectivity of the medium that determines an intensity of the reflected radiation, frequency or frequencies of reflected radiation, a pattern of the reflected radiation and an angle of the reflective medium that determines a direction of the reflected radiation.

The "degree of reflectivity" is used to indicate a ratio of energy or power of reflected radiation from the reflective medium to energy or power of incident radiation onto the reflective medium. The term "intensity," like degree of reflectivity is used as a measure of energy or power. Degree of reflectivity and intensity are used as measures of power or energy. These measures may be per unit area or averaged over a larger area when appropriate. In some aspects of the present invention, a time-averaged application is desirable and energy is a more appropriate measure. In other aspects of the present invention, a lighting application that changes with time is desired and power may be the more appropriate measure. Even when light is intended to change with time, some time-averaging may still be pertinent. As such, in aspects of the present invention where reflectivity is varied with time, the degree of reflectivity and intensity are measures of power and when a substantially steady reflectivity is utilized, these terms are measures of energy. Further, each term may indicate power or energy per unit area of an arbitrary surface or averaged over an arbitrary surface. Both terms are used in a relative manner such that if, for example, one is measured as power and per unit area of a reference surface, the other should have the same units measured with respect to the same reference surface. Or, if one is measured as energy and averaged over the reference surface, the other should have the same units and with respect to the same reference surface. The reference surface is often the surface of the reflector.

Frequency or frequencies of the reflected radiation determine a "color" of the reflected radiation if they fall within the visible range. The radiation may include visible light or radiation having frequencies below or above the frequency of visible light.

The "pattern" of reflected radiation indicates a variation in the intensity and color of the light that is reflected from various portions of the reflective medium.

The direction of the reflected radiation depends on the angle of incidence of the incident light on the reflective surface. The direction of the reflected radiation may be changed if a rigid reflective surface is rotated with respect to the incident rays, or if a flexible reflective surface is deformed such that an area or point of incidence of the incident rays is rotated with respect to the incident rays without rotating the entire surface or medium.

While the foregoing exemplary embodiments are described in the context of visible light, the invention may be applied to controlling reflected electromagnetic waves with frequencies or wavelengths below and above the visible range. For example, the reflectivity of infra-red waves used in night vision, ultra-violet waves used in semiconductor processing, millimeter waves used in imaging through dense media, or radar waves may be controlled by appropriate types of ePaper. The wavelengths recited and the applications recited for each wavelength are exemplary. Embodiments of the present invention pertain to methods and systems for reflecting electromagnetic waves using a reflective medium having electronically variable reflectivity.

Figure 11:
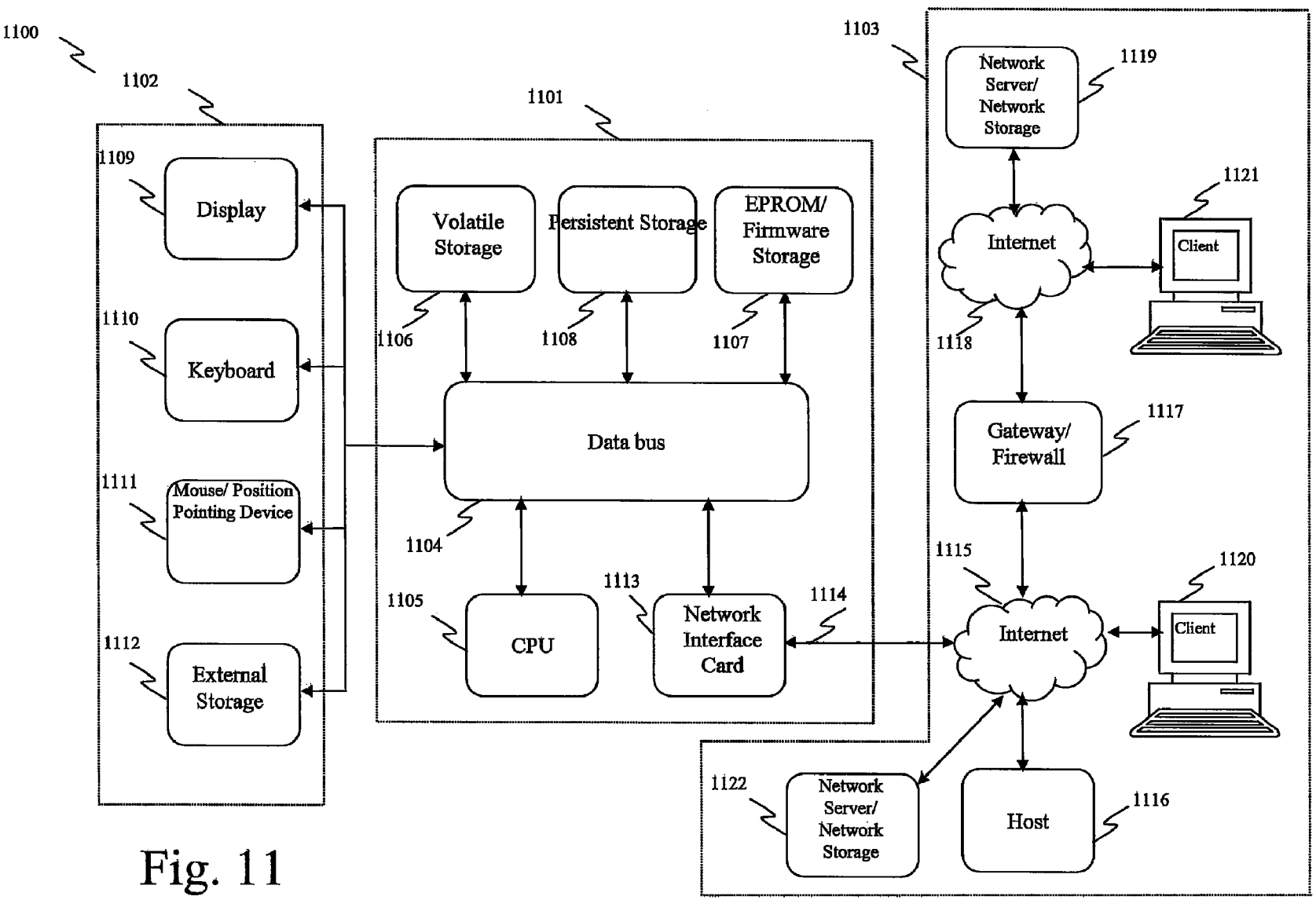
FIG. 11 illustrates an exemplary embodiment of a computer platform upon which the inventive system may be implemented.

FIG. 11 is a block diagram that illustrates an embodiment of a computer/server system 1100 upon which an embodiment of the inventive methodology may be implemented. The system 1100 includes a computer/server platform 1101, peripheral devices 1102 and network resources 1103.

The computer platform 1101 may include a data bus 1105 or other communication mechanism for communicating information across and among various parts of the computer platform 1101, and a processor 1105 coupled with bus 1101 for processing information and performing other computational and control tasks. Computer platform 1101 also includes a volatile storage 1106, such as a random access memory (RAM) or other dynamic storage device, coupled to bus 1105 for storing various information as well as instructions to be executed by processor 1105. The volatile storage 1106 also may be used for storing temporary variables or other intermediate information during execution of instructions by processor 1105. Computer platform 1101 may further include a read only memory (ROM or EPROM) 1107 or other static storage device coupled to bus 1105 for storing static information and instructions for processor 1105, such as basic input-output system (BIOS), as well as various system configuration parameters. A persistent storage device 1108, such as a magnetic disk, optical disk, or solid-state flash memory device is provided and coupled to bus 1101 for storing information and instructions.

Computer platform 1101 may be coupled via bus 1105 to a display 1109, such as a cathode ray tube (CRT), plasma display, or a liquid crystal display (LCD), for displaying information to a system administrator or user of the computer platform 1101. An input device 1110, including alphanumeric and other keys, is coupled to bus 1101 for communicating information and command selections to processor 1105. Another type of user input device is cursor control device 1111, such as a mouse, a trackball, or cursor direction keys for communicating direction information and command selections to processor 1105 and for controlling cursor movement on display 1109. This input device typically has two degrees of freedom in two axes, a first axis (e.g., x) and a second axis (e.g., y), that allows the device to specify positions in a plane.

An external storage device 1112 may be coupled to the computer platform 1101 via bus 1105 to provide an extra or removable storage capacity for the computer platform 1101. In an embodiment of the computer system 1100, the external removable storage device 1112 may be used to facilitate exchange of data with other computer systems.

The invention is related to the use of computer system 1100 for implementing the techniques described herein. In an embodiment, the inventive system may reside on a machine such as computer platform 1101. According to one embodiment of the invention, the techniques described herein are performed by computer system 1100 in response to processor 1105 executing one or more sequences of one or more instructions contained in the volatile memory 1106. Such instructions may be read into volatile memory 1106 from another computer-readable medium, such as persistent storage device

1108. Execution of the sequences of instructions contained in the volatile memory 1106 causes processor 1105 to perform the process steps described herein. In alternative embodiments, hard-wired circuitry may be used in place of or in combination with software instructions to implement the invention. Thus, embodiments of the invention are not limited to any specific combination of hardware circuitry and software.

The term "computer-readable medium" as used herein refers to any medium that participates in providing instructions to processor 1105 for execution. The computer-readable medium is just one example of a machine-readable medium, which may carry instructions for implementing any of the methods and/or techniques described herein. Such a medium may take many forms, including but not limited to, non-volatile media, volatile media, and transmission media. Non-volatile media includes, for example, optical or magnetic disks, such as storage device 1108. Volatile media includes dynamic memory, such as volatile storage 1106. Transmission media includes coaxial cables, copper wire and fiber optics, including the wires that comprise data bus 1105. Transmission media can also take the form of acoustic or light waves, such as those generated during radio-wave and infra-red data communications.

Common forms of computer-readable media include, for example, a floppy disk, a flexible disk, hard disk, magnetic tape, or any other magnetic medium, a CD-ROM, any other optical medium, punchcards, papertape, any other physical medium with patterns of holes, a RAM, a PROM, an EPROM, a FLASH-EPROM, a flash drive, a memory card, any other memory chip or cartridge, a carrier wave as described hereinafter, or any other medium from which a computer can read.

Various forms of computer readable media may be involved in carrying one or more sequences of one or more instructions to processor 1105 for execution. For example, the instructions may initially be carried on a magnetic disk from a remote computer. Alternatively, a remote computer can load the instructions into its dynamic memory and send the instructions over a telephone line using a modem. A modem local to computer system 1100 can receive the data on the telephone line and use an infra-red transmitter to convert the data to an infra-red signal. An infra-red detector can receive the data carried in the infra-red signal and appropriate circuitry can place the data on the data bus 1105. The bus 1105 carries the data to the volatile storage 1106, from which processor 1105 retrieves and executes the instructions. The instructions received by the volatile memory 1106 may optionally be stored on persistent storage device 1108 either before or after execution by processor 1105. The instructions may also be downloaded into the computer platform 1101 via Internet using a variety of network data communication protocols well known in the art.

The computer platform 1101 also includes a communication interface, such as network interface card 1113 coupled to the data bus 1105. Communication interface 1113 provides a two-way data communication coupling to a network link 1115 that is coupled to a local network 1115. For example, communication interface 1113 may be an integrated services digital network (ISDN) card or a modem to provide a data communication connection to a corresponding type of telephone line. As another example, communication interface 1113 may be a local area network interface card (LAN NIC) to provide a data communication connection to a compatible LAN. Wireless links, such as well-known 802.11a, 802.11b, 802.11g and Bluetooth may also be used for network implementation. In any such implementation, communication interface 1113 sends and receives electrical, electromagnetic or optical signals that carry digital data streams representing various types of information.

Network link 1113 typically provides data communication through one or more networks to other network resources. For example, network link 1115 may provide a connection through local network 1115 to a host computer 1116, or a network storage/server 1117. Additionally or alternatively, the network link 1113 may connect through gateway/firewall 1117 to the wide-area or global network 1118, such as an Internet. Thus, the computer platform 1101 can access network resources located anywhere on the Internet 1118, such as a remote network storage/server 119. On the other hand, the computer platform 1101 may also be accessed by clients located anywhere on the local area network 1115 and/or the Internet 11 18. The network clients 1120 and 1121 may themselves be implemented based on the computer platform similar to the platform 1101.

Local network 1115 and the Internet 1118 both use electrical, electromagnetic or optical signals that carry digital data streams. The signals through the various networks and the signals on network link 1115 and through communication interface 1113, which carry the digital data to and from computer platform 1101, are exemplary forms of carrier waves transporting the information.

Computer platform 1101 can send messages and receive data, including program code, through the variety of network (s) including Internet 1118 and LAN 1115, network link 1115 and communication interface 1113. In the Internet example, when the system 1101 acts as a network server, it might transmit a requested code or data for an application program running on client(s) 1120 and/or 1121 through Internet 1118, gateway/firewall 1117, local area network 1115 and communication interface 1113. Similarly, it may receive code from other network resources.

The received code may be executed by processor 1105 as it is received, and/or stored in persistent or volatile storage devices 1108 and 1106, respectively, or other non-volatile storage for later execution. In this manner, computer system 1101 may obtain application code in the form of a carrier wave.

It should be noted that the present invention is not limited to any specific firewall system. The inventive policy-based content processing system may be used in any of the three firewall operating modes and specifically NAT, routed and transparent.

Finally, it should be understood that processes and techniques described herein are not inherently related to any particular apparatus and may be implemented by any suitable combination of components. Further, various types of general purpose devices may be used in accordance with the teachings described herein. It may also prove advantageous to construct specialized apparatus to perform the method steps described herein. The present invention has been described in relation to particular examples, which are intended in all respects to be illustrative rather than restrictive. Those skilled in the art will appreciate that many different combinations of hardware, software, and firmware will be suitable for practicing the present invention. For example, the described software may be implemented in a wide variety of programming or scripting languages, such as Assembler, C/C++, perl, shell, PHP, Java, etc.

Moreover, other implementations of the invention will be apparent to those skilled in the art from consideration of the specification and practice of the invention disclosed herein. Various aspects and/or components of the described embodiments may be used singly or in any combination in the system for controlling lighting and lighting fixtures. It is intended that the specification and examples be considered as exemplary only, with a true scope and spirit of the invention being indicated by the following claims and their equivalents.

What is claimed is:

1. A system for controlling a lighting of a space, the system comprising:

a light source for providing an emitted light; and a reflector for receiving an incident light and reflecting the incident light as reflected light, the incident light including at least a portion of the emitted light, wherein the reflector includes an ePaper having an ePaper reflectivity;

wherein the ePaper reflectivity is controllable to control the lighting of the space; and a baffle for blocking at least a portion of the emitted light from directly reaching the space, wherein the baffle includes a baffle ePaper medium having an ePaper translucency, and wherein the ePaper translucency is controllable to further control the lighting of the space.

2. The system of claim 1, wherein a position of the baffle and light diffusion properties of the baffle are controllable to control a ratio of the reflected light to the emitted light in the space.

3. The system of claim 1, wherein the light source is adapted to provide light of substantially constant intensity.

4. The system of claim 1, further comprising:

a dimmer connected with the light source for varying an intensity of the emitted light at the light source.

5. The system of claim 1, wherein the incident light is primarily the emitted light.

6. The system of claim 1, wherein the incident light includes direct emitted light reaching the reflector along a direct path from the light source and indirect emitted light reaching the reflector along an indirect path from the light source.

7. The system of claim 1, wherein the reflector includes a frame, and wherein the ePaper is installed over the frame.

8. The system of claim 1, wherein the ePaper reflectivity includes a direction of the reflected light, and wherein a flexible shape of the reflector is controllable to control the direction of the reflected light.

9. The system of claim 1, wherein the ePaper reflectivity includes a degree of reflectivity, and wherein the degree of reflectivity is controllable to control an intensity of the reflected light.

10. The system of claim 9, wherein the degree of reflectivity is controllable substantially between 0% and 100%.

11. The system of claim 1, wherein the ePaper reflectivity includes a pattern, and wherein the pattern is controllable to control a pattern of the reflected light.

12. The system of claim 1, wherein the ePaper reflectivity includes a color, and wherein the color is controllable to control a color of the reflected light.

13. The system of claim 1, further comprising:

a power source connected with the ePaper for controlling the ePaper reflectivity.

14. A method for controlling a lighting of a space by controlling a light fixture, the light fixture including a light source providing emitted light, a baffle, and ePaper media for controlling the emitted light, the method comprising:

determining a desired lighting in the space;

adjusting lighting characteristics of the ePaper media responsive to the desired lighting;

modifying the emitted light by controlling the lighting characteristics of the ePaper media to obtain a modified light; and lighting the space with light including the modified light, wherein the baffle is an ePaper baffle that includes the ePaper media, and wherein adjusting lighting characteristics of the ePaper media includes adjusting translucency characteristics of the ePaper baffle responsive to the desired lighting.

15. The method of claim 14, wherein the ePaper media include an ePaper reflective medium reflecting incident light upon the ePaper reflective medium to provide reflected light, wherein adjusting lighting characteristics of the ePaper media includes adjusting reflectivity characteristics of the ePaper reflective medium responsive to the desired lighting, wherein modifying the emitted light by controlling the lighting characteristics of the ePaper media includes shining the emitted light onto the ePaper reflective medium, and wherein the modified light includes the reflected light.

16. The method of claim 15, further comprising:

determining characteristics of the light source; and adjusting the reflectivity characteristics of the ePaper reflective medium responsive to the characteristics of the light source.

17. The method of claim 15, wherein adjusting reflectivity characteristics of the ePaper reflective medium includes:

adjusting a degree of reflectivity of the ePaper reflective medium;

adjusting a color of the ePaper reflective medium;

adjusting a pattern of the ePaper reflective medium; and adjusting one or more angles of the ePaper reflective medium.

18. The method of claim 15, wherein adjusting reflectivity characteristics of the ePaper reflective medium is performed automatically by electronic instrumentation.

19. The method of claim 14, further comprising:

determining characteristics of the light source; and adjusting the translucency characteristics of the ePaper baffle responsive to the characteristics of the light source.

20. The method of claim 14, wherein adjusting translucency characteristics of the ePaper baffle is performed automatically by electronic instrumentation.

21. A method for controlling a lighting of a space by controlling a light fixture, the light fixture including a light source providing emitted light, a baffle, and ePaper media for controlling the emitted light, the method comprising:

determining a desired lighting in the space;

adjusting lighting characteristics of the ePaper media responsive to the desired lighting;

modifying the emitted light by controlling the lighting characteristics of the ePaper media to obtain a modified light; and lighting the space with light including the modified light, wherein determining characteristics of the light source includes:

determining an intensity of the emitted light;

determining a color of the emitted light;

determining a shift in the color of the emitted light with time; and determining an ability to dim the emitted light at the light source.

22. A method for controlling a lighting of a space by controlling a light fixture, the light fixture including a light source providing emitted light, a baffle, and ePaper media for controlling the emitted light, the method comprising:

determining a desired lighting in the space;

adjusting lighting characteristics of the ePaper media responsive to the desired lighting;

modifying the emitted light by controlling the lighting characteristics of the ePaper media to obtain a modified light; and lighting the space with light including the modified light, wherein determining desired lighting in the space includes:

determining an intensity of the desired lighting;

determining a color of the desired lighting;

determining a pattern of the desired lighting; and determining a contribution to the desired lighting by the light fixture.

23. A method for controlling lighting in a space, the method comprising:

receiving a first light in the space;

providing at least one medium including ePaper having controllable ePaper lighting characteristics, the medium receiving an incident light, the incident light including the first light;

providing a baffle for blocking at least a portion of the emitted light from directly reaching the space, wherein the baffle includes a baffle ePaper medium having an ePaper translucency, wherein the ePaper translucency is controllable to further control the lighting of the space; and controlling the ePaper lighting characteristics to control the lighting in the space.

24. The method of claim 23, wherein the first light includes natural light and artificial light.

25. The method of claim 23, wherein the medium includes an ePaper translucent medium having controllable translucency.

26. The method of claim 23, wherein the medium includes an ePaper reflector and reflects at least a portion of the incident light as a reflected light, wherein a color of the reflected light is controllable, and wherein a pattern of the reflected light is controllable.

27. The method of claim 23, wherein the medium is flexible, and wherein a flexible shape of the medium is controllable.

28. The method of claim 23, further comprising:

controlling the first light simultaneously with controlling the ePaper lighting characteristics to control the lighting in the space.

29. A light fixture for lighting a space, the light fixture comprising:

a light source for emitting an emitted light;

a baffle for blocking at least a portion of the emitted light from directly reaching the space;

a reflector for reflecting an incident light on the reflector as reflected light, the reflector including an ePaper reflective medium having a controllable reflectivity;

a dimmer connected with the light source for varying an intensity of the emitted light at the light source;

a first power source connected with the light source for supplying power to the light source;

a second power source connected with the ePaper reflective medium for writing to the ePaper reflective medium; and an electronic circuit connected with the second power source for controlling the ePaper reflective medium, wherein the incident light includes direct emitted light reaching the reflector along a direct path from the light source and indirect emitted light reaching the reflector along an indirect path from the light source, wherein the reflector includes a frame for holding the ePaper reflective medium, wherein a position of the baffle and light diffusion properties of the baffle are controllable to control a ratio of the reflected light to the emitted light in the space, wherein the controllable reflectivity of the ePaper is controllable to:

control an intensity of the reflected light, effect a gross shade shift from black to gray to white, control a color of the reflected light, effect simple color shifts from full red, to yellow or green, control a pattern of the reflected light, and control a direction of the reflected light, and wherein the baffle includes translucent ePaper having controllable translucency.

* * * * *